US005901679A

United States Patent [19]

Tanaka et al.

[11] Patent Number: 5,901,679

[45] Date of Patent: May 11, 1999

[54] ENGINE FOR VEHICLE

[75] Inventors: Shigekazu Tanaka; Takashi Taguchi; Shigemasa Kajiwara; Masashi Murata; Atsushi Iwamoto; Toshinari Sonoda; Masahiko Tashiro; Yasuyuki Kimura; Kaoru Aoki; Mitsuo Takashima, all of Wako, Japan

[73] Assignee: Honda Giken Kogyo Kabushiki Kaisha, Tokyo, Japan

[21] Appl. No.: 08/951,732

[22] Filed: Oct. 16, 1997

[30] Foreign Application Priority Data

| | | | |
|---|---|---|---|
| Oct. 16, 1996 | [JP] | Japan | 8-273319 |
| Oct. 16, 1996 | [JP] | Japan | 8-273320 |
| Oct. 23, 1996 | [JP] | Japan | 8-280866 |
| Nov. 19, 1996 | [JP] | Japan | 8-308254 |

[51] Int. Cl.[6] ..... F02F 7/00

[52] U.S. Cl. ..... 123/195 C; 123/195 H

[58] Field of Search ..... 123/195 C, 195 H, 123/196 R

[56] References Cited

FOREIGN PATENT DOCUMENTS

| | | |
|---|---|---|
| 0 411 319 A2 | 2/1991 | European Pat. Off. . |
| 482482 | 3/1917 | France . |
| 2 024 078 | 8/1970 | France . |
| 2 327 440 | 5/1977 | France . |
| 196 04 547 a1 | 8/1996 | Germany . |
| 59-50864 | 12/1984 | Japan . |
| 129730 | 7/1919 | United Kingdom . |

*Primary Examiner*—Noah P. Kamen

*Attorney, Agent, or Firm*—Nikaido, Marmelstein, Murray & Oram LLP

[57] ABSTRACT

In an engine for a vehicle including a bearing cap integral type oil pan which has a plurality of bearing cap sections integrally provided thereon and which is integrally coupled to a cylinder block, connecting bolts are screwed into the bearing cap sections from the cylinder block to integrally couple the cylinder block and the oil pan to each other. An oil pan chamber, which is an as-cast bore made by drawing a die in an axial direction of a crankshaft, is defined to extend continuously in the axial direction of the crankshaft between the bearing cap sections and a bottom wall of the oil pan. Thus, the oil pan can be produced simply, at a low cost, by a casting process and moreover, it is possible to reduce the weight and size of the oil pan and increase the rigidity of the oil pan.

21 Claims, 18 Drawing Sheets

$14_1$
$66_5$
107
$17_5$
$64_5$
$71_4$
60
67
$65_5$
$65_4$
61
118
57
$65_3$
120
61
$65_2$
$65_1$
53
Co
$71_1$
$17_1$
$64_1$
$71_2$
$17_2$
80
73
$17_3$
$71_3$
$64_3$
$17_4$
$64_4$
91
87
$66_3$
58
74
$66_1$
76
61
107
50
25
59
27
51

ENGINE FOR VEHICLE

BACKGROUND OF THE INVENTION

1. Field of the Invention

The present invention relates to an improvement of an engine for a vehicle, including a bearing cap-integral type oil pan integrally provided with bearing cap sections and coupled to a cylinder block.

2. Description of the Related Art

A conventionally known an engine for a vehicle is disclosed, for example, in Japanese Patent Publication No. 59-50864, in which an oil pan integrally provided with a plurality of bearing cap sections for supporting a crankshaft, is coupled to an end face of a cylinder block on the side of a crank chamber by connecting bolts.

In the above known engine for a vehicle, however, the following problems are encountered: (1) Since the oil pan is fastened to the cylinder block by connecting bolts passing through bolt bores in a bottom wall of the oil pan, seal means are required in the bolt bores, resulting in an increased number of parts. (2) The opening of the bolt bores brings about a reduction in rigidity of the oil pan itself. (3) Since the plurality of bearing cap sections extend to the bottom wall of the oil pan and are integrally connected to the bottom wall, an increase in weight of the oil pan is brought about. (4) The structure of the oil pan itself is complicated, and the mold for forming the oil pan by casting is complicated, resulting in an increased manufacturing cost.

SUMMARY OF THE INVENTION

Accordingly, it is an object of the present invention to provide a novel engine for a vehicle, wherein all of the above problems (1) to (4) are overcome.

To achieve the above object, according to the present invention, there is provided an engine for a vehicle, comprising a bearing cap-integral type oil pan integrally provided with bearing cap sections and integrally coupled to a cylinder block, wherein said cylinder block and the oil pan are integrally coupled to each other by screwing connecting bolts through the cylinder block into the bearing cap sections. The oil pan has an oil pan chamber which is an as-cast bore made by drawing a die in an axial direction of a crankshaft and which is defined to extend continuously in the axial direction of the crankshaft between the bearing cap section s and a bottom wall of the oil pan.

With such configuration, it is easy to produce the oil pan by a casting process and moreover, it is possible to provide reductions in weight and size of the oil pan and it is easy to ensure the capacity of the oil pan. In addition, it is unnecessary to provide mounting bores such as bolt bores in the oil pan and hence, sealing means for the mounting bores are not required; the structure is not complicated, and it is easy to ensure the rigidity of the oil pan itself.

According to another aspect and feature of the present invention, the engine further includes a timing transmitting mechanism provided at one end of the cylinder block in the axial direction of the crankshaft for transmitting a driving force from the crankshaft to a valve operating cam shaft, and a transmitting case covering the timing transmitting mechanism and integrally provided with an extension which extends below a lower end of the cylinder block. The oil pan has an oil pan body which has an open end face at one end in the axial direction of the crankshaft and which is coupled to a lower surface of the cylinder block. The oil pan is comprised of the oil pan body and the extension coupled to the open end face of the oil pan body. Thus, a portion of the transmitting case can be utilized as a portion of the oil pan, and a required amount of a lubricating oil within the oil pan can be ensured without relying on an increase in size of the oil pan body.

According to a further aspect and feature of the present invention, the oil pan body integrally provided with the plurality of bearing cap sections, is coupled to a lower surface of the cylinder block and the oil pan chamber having an opening at one end in the axial direction of the crankshaft, is defined between the bottom wall of the oil pan body and the bearing cap sections. An oil pump accommodated in the oil pan chamber through the opening, is mounted on the oil pan body, and the opening is closed by a lid. Thus, notwithstanding that the oil pan is integrally provided with the bearing cap sections, the mounting of the oil pump in the oil pan chamber and the maintenance of the oil pump after the mounting thereof, are facilitated and moreover, the position of mounting of the oil pump is not limited.

According to a yet further aspect and feature of the present invention, the connecting bolts are through bolts for fastening the cylinder block between a cylinder head and the bearing cap sections. Annular oil return passages or annular blow-by gas passages are defined between the through bolts and inner surfaces of bolt insertion bores which are provided in the cylinder block and through which the through bolts are inserted. Thus, it is not required that a space for defining the annular oil return passages or annular blow-by gas passages be specially provided in the cylinder block, and such space can be made relatively small. Further, the size of the cylinder block is not increased with the formation of the annular oil return passages or annular blow-by gas passages.

The above and other objects, features and advantages of the present invention will become apparent from the following description of the preferred embodiment taken in conjunction with the accompanying drawings.

BRIEF DESCRIPTION OF THE DRAWINGS

FIGS. 1 to 18 illustrate an embodiment of the present invention, wherein FIG. 1 is a partially cutaway side view of an engine.

FIG. 2 is a partially cutaway front view of the engine.

FIG. 3 is a sectional view taken along a line 3—3 in FIG. 1.

FIG. 4 is a partial sectional view of the engine taken along a line 4—4 in FIG. 2.

FIG. 5 is an enlarged view taken in a direction of an arrow 5—5 in FIG. 1.

FIG. 6 is a sectional view taken along a line 6—6 in FIG. 5.

FIG. 7 is a perspective view of an oil pan body.

FIG. 8 is a plan view of an oil pan body.

FIG. 9 is a sectional view taken along a line 9—9 in FIG. 8.

FIG. 10 is a view taken in a direction of an arrow 10—10 in FIG. 8.

FIG. 11 is a sectional view taken along a line 11—11 in FIG. 8.

FIG. 12 is a sectional view taken along a line 12—12 in FIG. 8.

FIG. 13 is an enlarged sectional view taken along a line 13—13 in FIG. 8.

FIG. 14 is a side view of the engine body with an intake manifold omitted, taken in the direction of arrow 14—14 in FIG. 3.

FIG. 15 is a sectional view taken along a line 15—15 in FIG. 14.

FIG. 16 is a sectional view taken along a line 16—16 in FIG. 14.

FIG. 17 is a sectional view taken along a line 17—17 in FIG. 14.

FIG. 18 is an enlarged sectional view taken along a line 18—18 in FIG. 1.

DETAILED DESCRIPTION OF THE PREFERRED EMBODIMENTS

Figure 1:
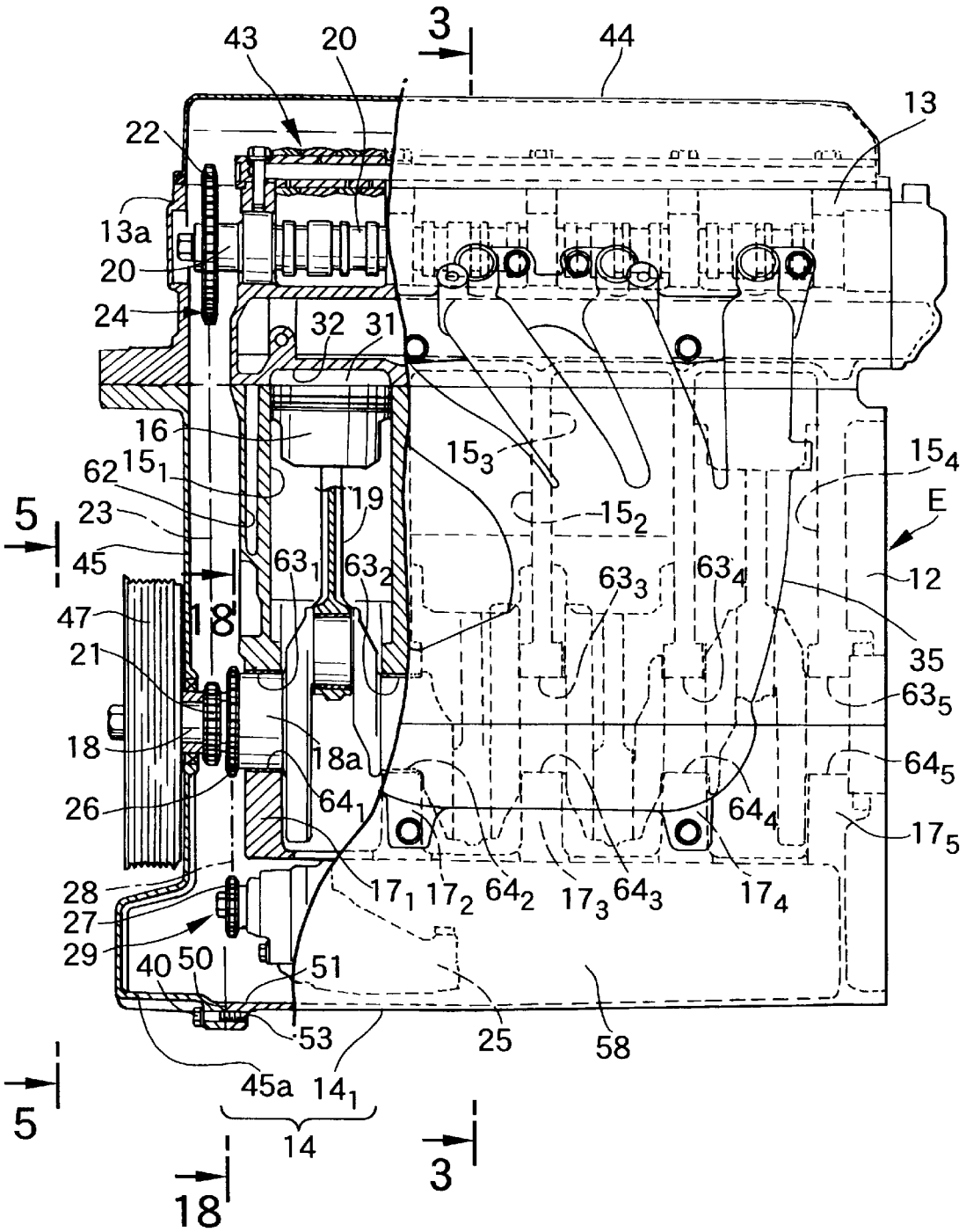
Figure 2:
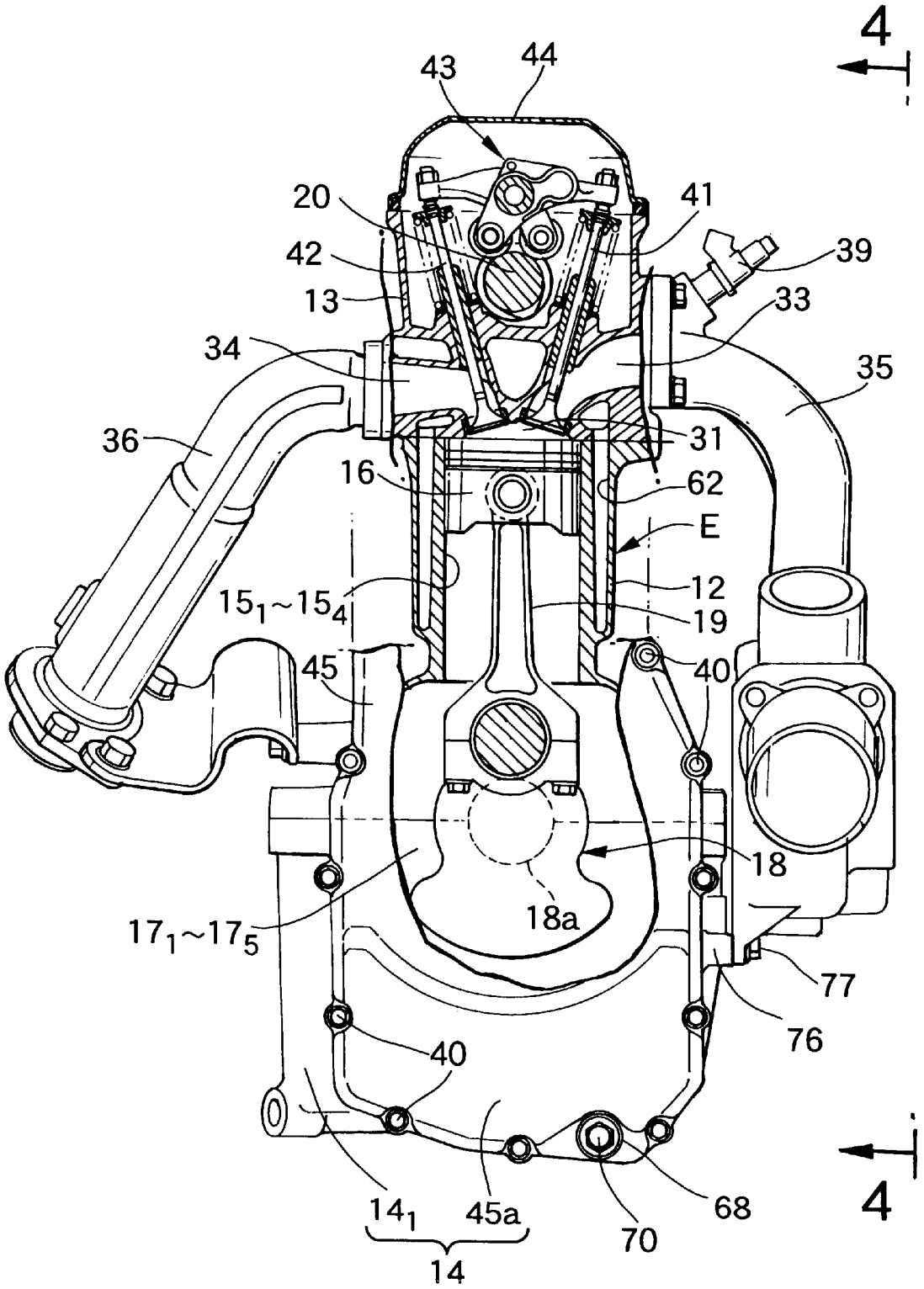

The present invention will now be described by way of an embodiment applied to a serial 4-cylinder and 4-cycle engine with reference to the accompanying drawings. Referring first to FIGS. 1 to 4, an engine body E of a serial 4-cylinder engine is comprised of a cylinder block 12, a cylinder head 13 coupled to a deck surface of the cylinder block 12 with a gasket therebetween, and a bearing cap-integral type oil pan 14 coupled to a lower surface of the cylinder block 12 with a gasket therebetween.

The cylinder block 12 is provided with first, second, third and fourth cylinder bores $\mathbf{15}_1$, $\mathbf{15}_2$, $\mathbf{15}_3$ and $\mathbf{15}_4$ arranged in series, and with a water jacket 62 surrounding the cylinder bores $\mathbf{15}_1$, $\mathbf{15}_2$, $\mathbf{15}_3$ and $\mathbf{15}_4$. A piston 16 is slidably received in each of the cylinder bores $\mathbf{15}_1$, $\mathbf{15}_2$, $\mathbf{15}_3$ and $\mathbf{15}_4$. Crank journal portions 18*a* of a crankshaft 18 are rotatably supported between the cylinder block 12 and first, second, third, fourth and fifth bearing cap sections $\mathbf{17}_1$, $\mathbf{17}_2$, $\mathbf{17}_3$, $\mathbf{17}_4$ and $\mathbf{17}_5$ integrally provided on the oil pan 14, and the pistons 16 are connected to the crankshaft 18 through connecting rods 19.

A valve operating cam shaft 20 is rotatably supported in the cylinder head 13 and has an axis parallel to the crankshaft 18. A timing transmitting mechanism 24 is mounted between one end of the valve operating cam shaft 20 and one end of the crankshaft 18 and comprises a driving sprocket 21 fixed to the crankshaft 18, a follower sprocket 22 fixed to the valve operating cam shaft 20, and an endless timing chain 23 reeved around both the sprockets 21 and 22. Thus, the rotation of the crankshaft 18 is transmitted at a reduction ratio of 1/2 to the valve operating cam shaft 20 by the timing transmitting mechanism 24. A power transmitting means 29 is mounted between an oil pump 25 accommodated and disposed within oil pan 14 and one end of the crankshaft 18. The power transmitting means 29 is comprised of a driving sprocket 26 fixed to the crankshaft 18, a follower sprocket 27 fixed to an input shaft of the oil pump 25, and an endless chain 28 reeved around both the sprockets 26 and 27. Thus, the rotational power of the crankshaft 18 is transmitted to the oil pump 25 through the power transmitting means 29.

A combustion chamber 31 is defined between the cylinder head 13 and the top of a piston 16 slidably received in each of the cylinder bores $\mathbf{15}_1$, $\mathbf{15}_2$, $\mathbf{15}_3$ and $\mathbf{15}_4$. Intake ports 33 and exhaust ports 34 corresponding to the combustion chambers 31 are provided in the cylinder head 13. An intake manifold 35 connected to intake ports 33, is connected to one side of the cylinder head 13, and an exhaust manifold 36 connected to the exhaust ports 34, is connected to the other side of the cylinder head 13. Moreover, fuel injection valves 39 corresponding to the combustion chambers 31, are mounted in an upper portion of the intake manifold 35.

A conventionally known valve operating mechanism 43 is operatively coupled to pairs of intake valves 41 disposed i in the combustion chambers 31 (each pair is disposed in each of the combustion chambers 31) so that they are capable of switchably putting the combustion chambers 31 and the intake ports 33 into and out of communication with each other. The valve operating mechanism is also operatively coupled to pairs of exhaust valves 42 disposed in the combustion chambers 31 (each pair is disposed in each of the combustion chambers 31) so that they are capable of switchably putting the combustion chambers 31 and the exhaust ports 34 into and out of communication with each other, and the valve operating cam shaft 20. A head cover 44 is coupled to an upper surface of the cylinder head 13 to cover the valve operating mechanism 43.

A substantial portion of the timing transmitting mechanism 24 and the power transmitting mechanism 29 are covered with a transmitting case 45 which is coupled to the cylinder block 12 and a case portion 13*a* integrally provided at one end of the cylinder head 13 in an axial direction of the crankshaft 18 by a plurality of bolts 40. The transmitting case 45 is integrally formed with an extension 45*a* which extends to below a lower end of the cylinder block 12.

Figure 5:
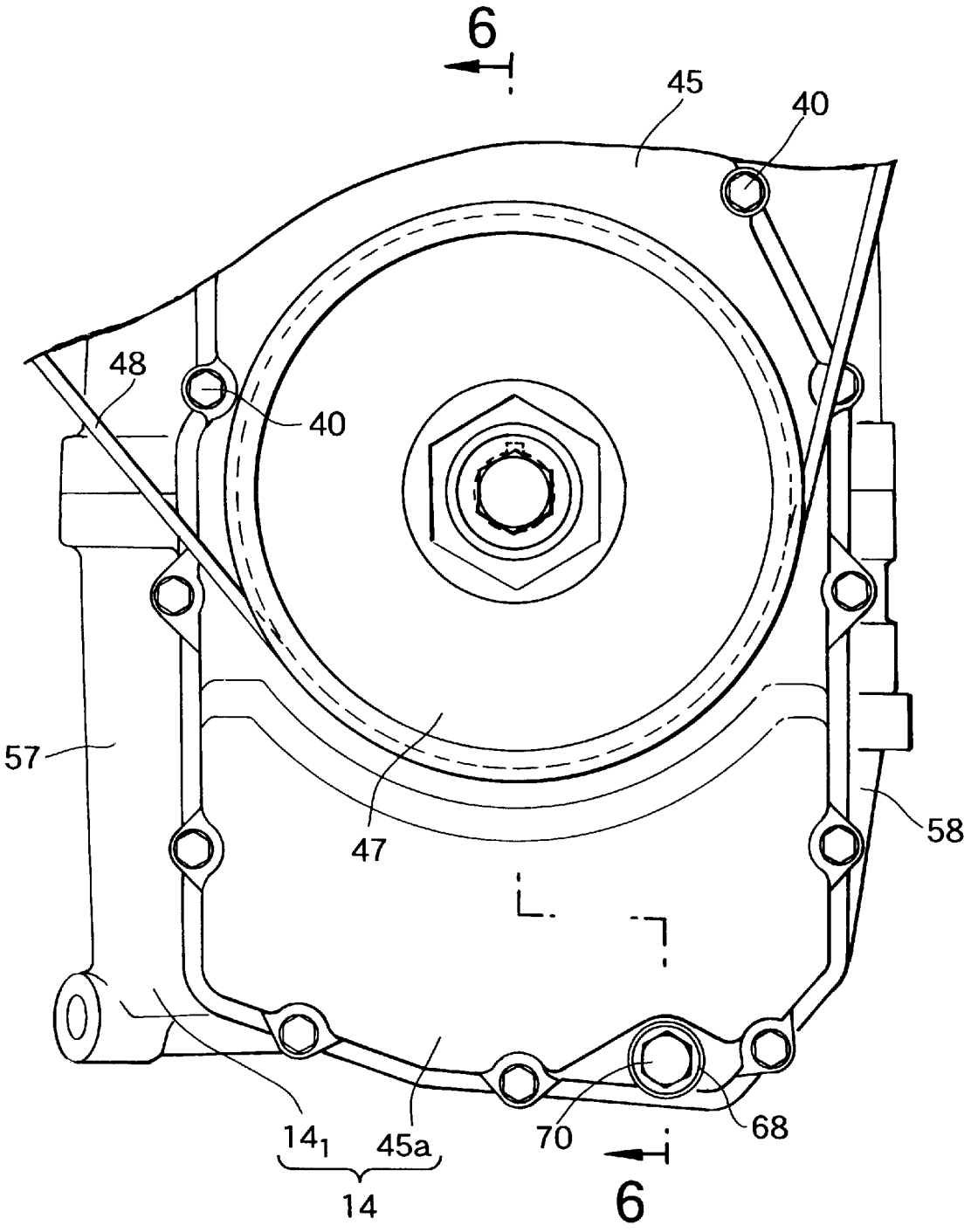
Figure 6:
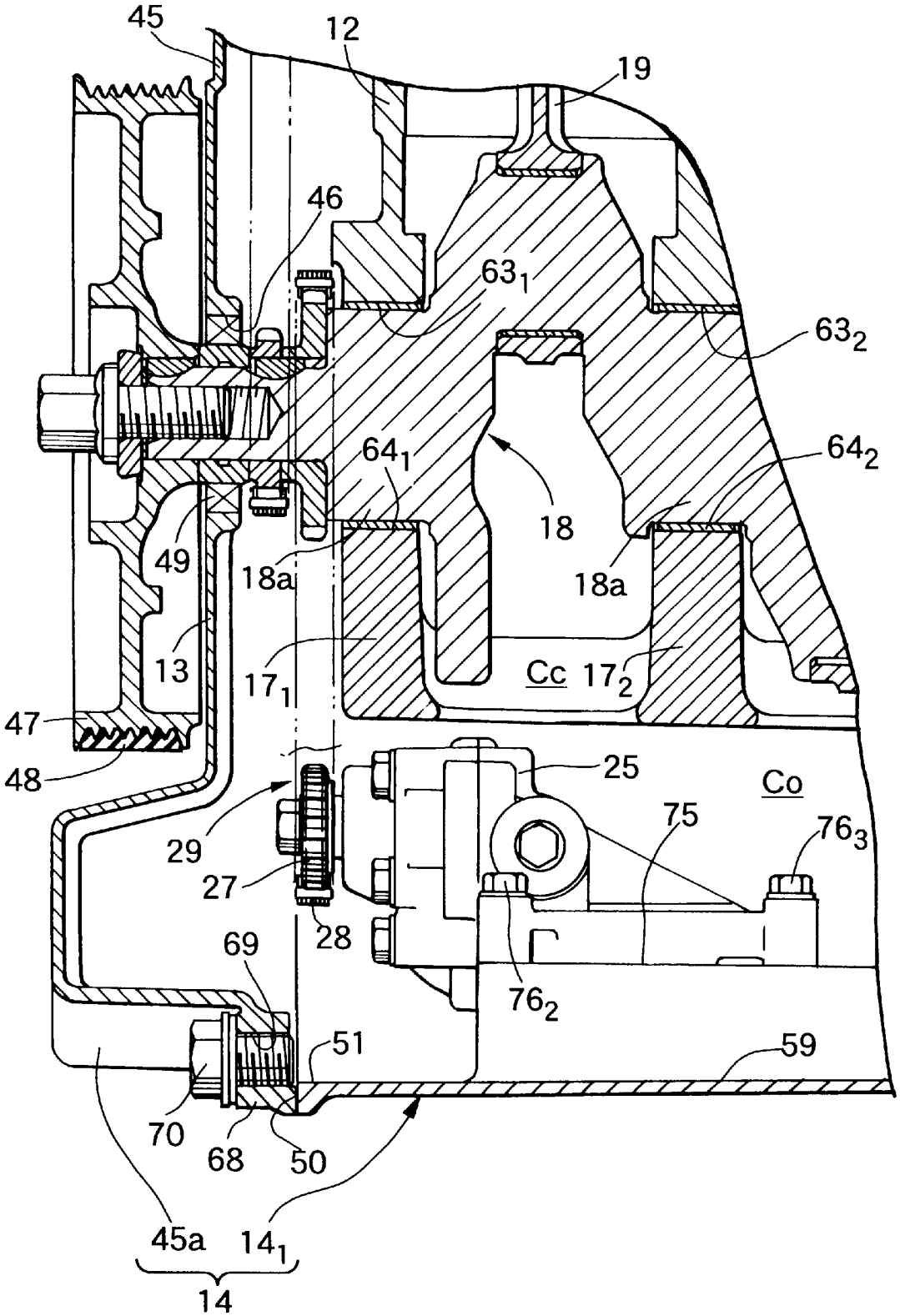

Referring also to FIGS. 5 and 6, an axial bore 46 is provided in the transmitting case 45 at a location above the extension 45*a*. One end of the crankshaft 18 protrudes through the axial bore 46 to the outside of the transmitting case 45, and a driving pulley 47 which is an auxiliary driving wheel is secured to an outer end of the crankshaft 18 and connected to an engine auxiliary such as a water pump (not shown) through an endless transmitting band 48. An oil seal means 49 is interposed between an outer surface of the crankshaft 18 and an inner surface of the axial bore 46.

The oil pan 14 is comprised of an oil pan body $\mathbf{14}_1$, coupled to a lower surface of the cylinder block 12 and having an open end face 50 at one end in an axial direction of the crankshaft 18, and the extension 45*a* coupled to the open end face 50 of the oil pan body $\mathbf{14}_1$.

Figure 7:
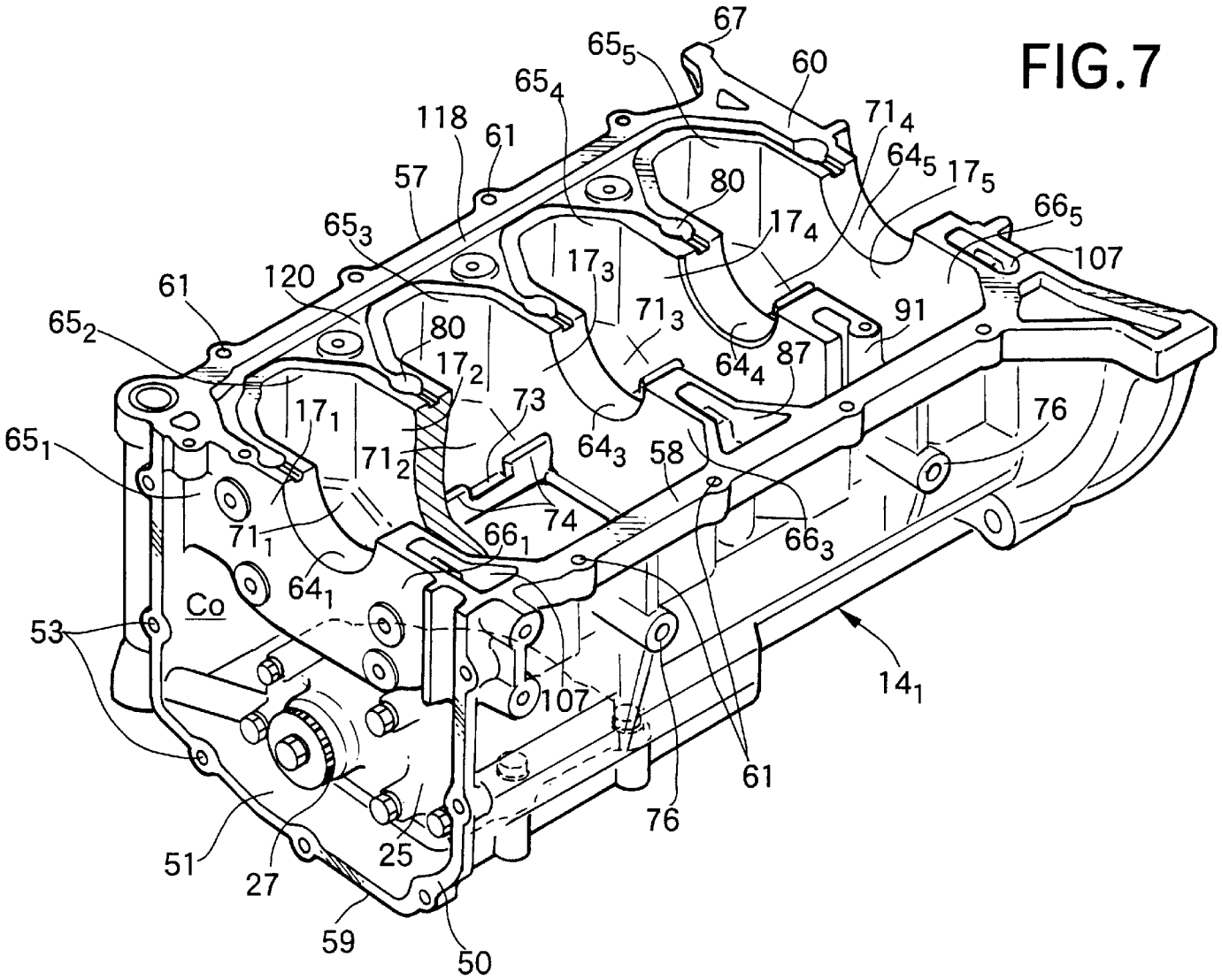
Figure 8:
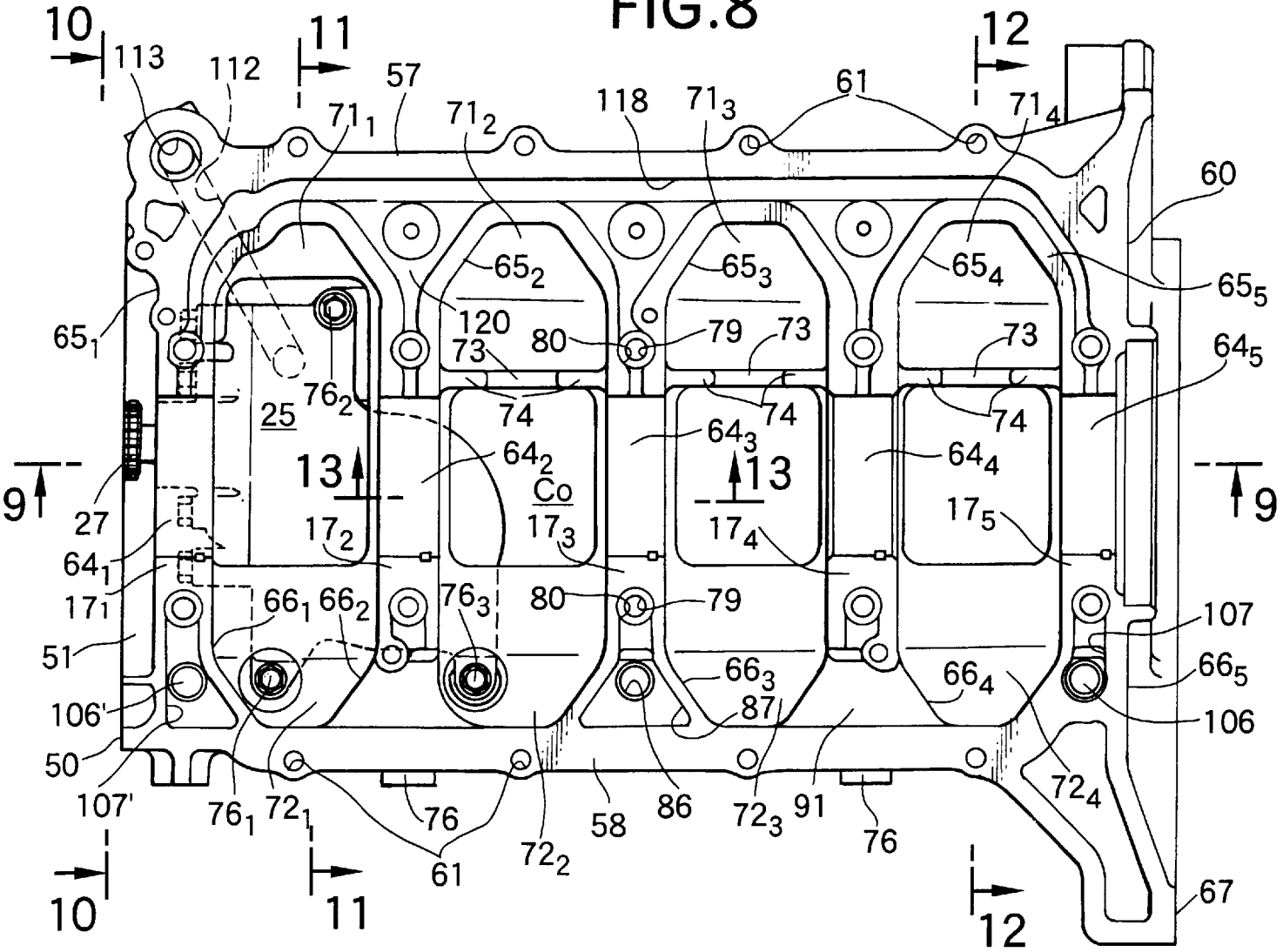
Figure 9:
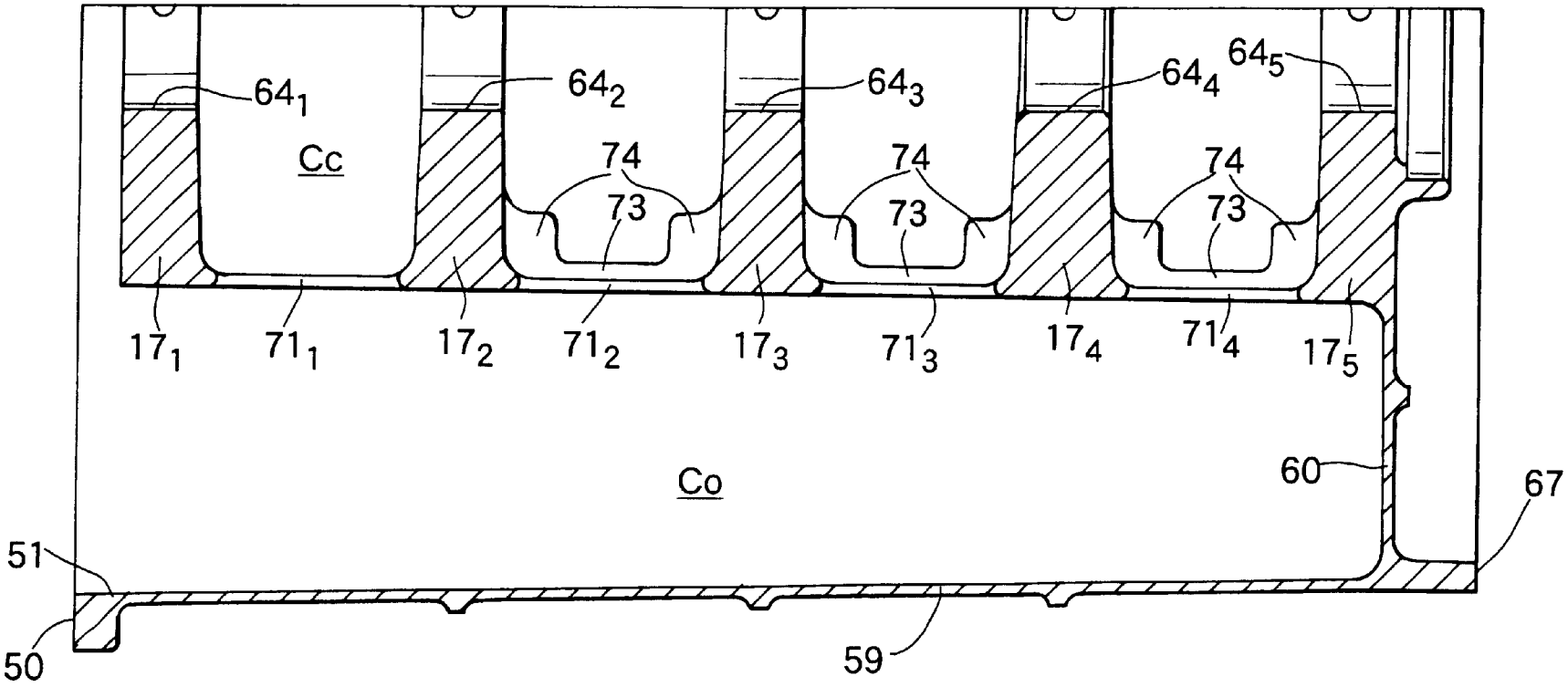
Figure 10:
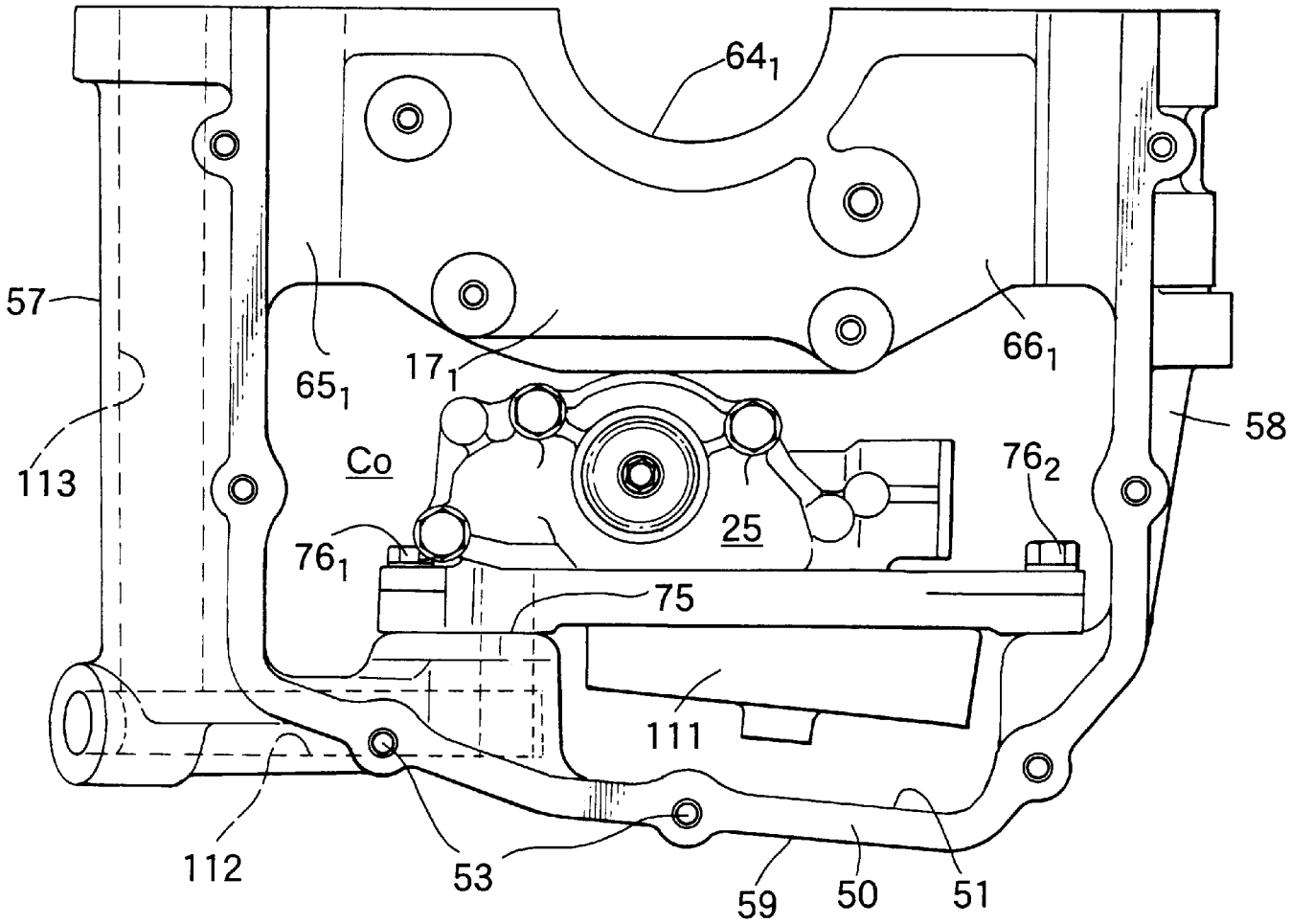
Figure 11:
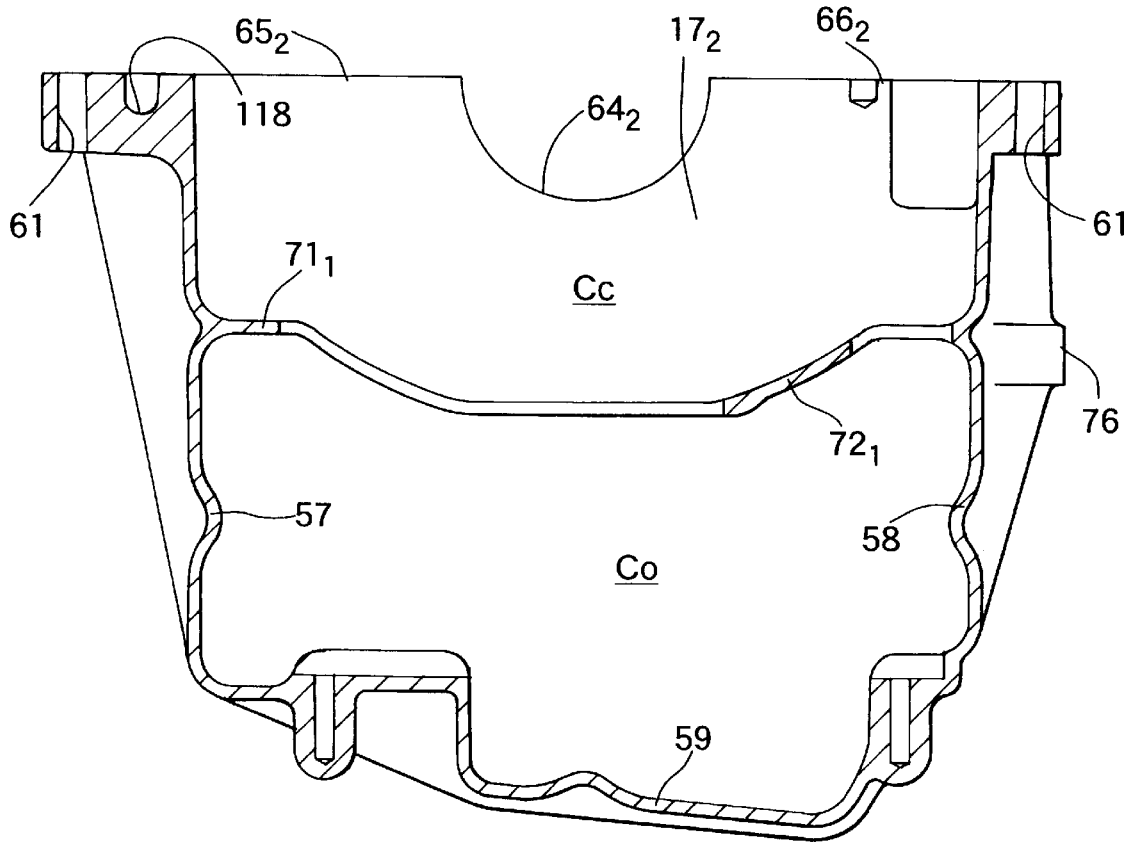

Referring also to FIG. 7, the oil pan body $\mathbf{14}_1$, is integrally made by a casting from a metal material such as Fe and Al alloys in such a manner that an oil pan chamber $C_O$ having an opening 51 is defined at one end in the axial direction of the crankshaft 18. The oil pan body $\mathbf{14}_1$ is fastened to the lower surface of the cylinder block 12 by a plurality of bolts 52. The open end face 50 of the oil pan body $\mathbf{14}_1$ is formed flush with one end face of the cylinder block 12 in the axial direction of the crankshaft 18. The extension 45*a* functioning as a lid for closing the opening 51 of the oil pan chamber $C_O$ is fastened to the open end face 50 by screwing the same bolts 40 as those fastening the transmitting case 45 to the cylinder block 12, into a plurality of bolt bores 53 provided in the open end face 50.

Moreover, the extension 45*a* of the transmitting case 45 is formed into a substantially U-shape with a vertically sectional contour opening towards the oil pan body $\mathbf{14}_1$ so as to protrude below the driving pulley 47. This increases the volume of the oil pan chamber $C_O$.

Further, referring also to FIGS. 8 to 13, the oil pan body $\mathbf{14}_1$ includes a left sidewall 57 extending substantially in the axial direction of the crankshaft 18 on the side of the exhaust manifold 36, a right sidewall 58 extending along the axis of the crankshaft 18 on the side opposite from the left sidewall 57, i.e., on the side of the intake manifold 35, and an end wall 60 which connects the left and right sidewalls 57 and 58 on the other side in the axial direction of the crankshaft 18, i.e., on the side opposite from the open end face 50. A plurality of bolt insertion bores 61 are provided in upper ends of each of the left and right sidewalls 57 and 58 spaced at distances in the axial direction of the crankshaft 18, and bolts 52 (see FIG. 3) are inserted through the bolt insertion bores 61 for fastening the left and right sidewalls 57 and 58 to the lower surface of the cylinder block 12.

The first, second, third, fourth and fifth bearing cap sections $17_1$, $17_2$, $17_3$, $17_4$ and $17_5$ are formed as walls perpendicular to the axis of the crankshaft 18 at locations equally spaced apart from one another in the axial direction of the crankshaft 18. The bearing cap sections $17_1$, $17_2$, $17_3$, $17_4$ and $17_5$ have semi-circular lower halves $64_1$, $64_2$, $64_3$, $64_4$ and $64_5$ formed on upper surfaces thereof for rotatably supporting the crank journal portions 18*a* of the crankshaft 18 by cooperation with semi-circular upper halves $63_1$, $63_2$, $63_3$, $63_4$ and $63_5$ (see FIG. 1) which are provided in a lower portion of the cylinder block 12.

Moreover, the bearing cap sections $17_1$, $17_2$, $17_3$, $17_4$ and $17_5$ are integrally connected to the left sidewall 57 of the oil pan body $14_1$ through connecting walls $65_1$, $65_2$, $65_3$, $65_4$ and $65_5$ and to the right sidewall 58 of the oil pan body $14_1$ through connecting walls $66_1$, $66_2$, $66_3$, $66_4$ and $66_5$. The fifth bearing cap section $17_5$ and the connecting walls $65_5$ and $66_5$ are integral with the end wall 60 of the oil pan body $14_1$. Further, the end wall 60 is integrally formed with a flange 67 for fastening a transmission case which is not shown.

The cave-like oil pan chamber $C_O$ is defined in lower half of the oil pan body $14_1$ by inner surfaces of the left and right sidewalls 57 and 58, a bottom wall 59 and the end wall 60 and lower surfaces of the bearing cap sections $17_1$, $17_2$, $17_3$, $17_4$ and $17_5$, so that it is open at the opening 51 at one end in the axial direction of the crankshaft 18 and is continuous in the axial direction of the crankshaft 18. The oil pan chamber $C_O$ is defined as an as-cast bore by drawing of a forming die such as a core when the oil pan body $14_1$ is integrally formed by a casting process. The inner surfaces of the left and right sidewalls 57 and 58, a bottom wall 59 and the end wall 60 and lower surfaces of the bearing cap sections $17_1$, $17_2$, $17_3$, $17_4$ and $17_5$ are formed so that their sections perpendicular to the axis of the crankshaft 18, are of substantially the same shape, and each of them has a drawing gradient such that it is divergent from the end wall 60 toward the opening 51. Thus, the bottom surface of the oil pan chamber $C_O$ is formed into a slope having a downward gradient from the end wall 60 toward the opening 51.

On the other hand, a boss portion 68 is provided on the oil pan body $14_1$ at a location corresponding to a lowermost portion of the open end face 50, i.e., at a lowermost portion of the extension 45*a*, and an oil discharge portion 69 provided in the boss portion 68 is closed by a plug 70. The provision of the oil discharge port 69 in the transmitting case 45 in the above manner makes it easy to ensure a sufficient distance of the oil pan 14 from the ground surface, and in particular, the plug 70 does not protrude downwards due to the fact that the axis of the oil discharge port 69 is established in a direction substantially parallel to the axial direction of the crankshaft 18.

The adjacent two of the first, second, third, fourth and fifth bearing cap sections $17_1$, $17_2$, $17_3$, $17_4$ and $17_5$ are integrally interconnected in a bridged manner by left baffle plates $71_1$, $71_2$, $71_3$ and $71_4$ and right baffle plates $72_1$, $72_2$, $72_3$ and $72_4$ on left and right opposite sides in a direction perpendicular to the axis of the crankshaft 18. The baffle plates $71_1$, $71_2$, $71_3$ and $71_4$ and $72_1$, $72_2$, $72_3$ and $72_4$ are formed to partition a portion of a connection between a crank chamber $C_C$ which is an upper half and the oil pan chamber $C_O$ which is a lower half of the inside of the oil pan 14. Thus, the waving of a lubricating oil within the oil pan chamber $C_O$ is inhibited by the baffle plates $71_1$, $71_2$, $71_3$ and $71_4$ and $72_1$, $72_2$, $72_3$ and $72_4$. Reinforcing walls 73 protruding toward the crank chamber $C_C$ are integrally formed at inner edges of the baffle plates lying on a side where the lubricating oil is splashed up by the rotation of the crankshaft 18 in one direction (in a direction indicated by an arrow a in FIG. 3), i.e., three $71_2$, $71_3$ and $71_4$ of the left baffle plates $71_1$, $71_2$, $71_3$ and $71_4$. The reinforcing walls 73 contribute to the ensuring of the rigidity of each of bearing cap sections $17_1$, $17_2$, $17_3$, $17_4$ and $17_5$ by cooperation with the left and right baffle plates $71_1$, $71_2$, $71_3$ and $71_4$ and $72_1$, $72_2$, $72_3$ and $72_4$. A pair of rib pieces 74 are integrally formed at longitudinally opposite ends of each of the reinforcing walls 73. The rib pieces 74 serve to inhibit the splashing-up of the lubricating oil within the oil pan chamber $C_O$ by the rotation of the crankshaft 18.

A mounting seat 75 for the oil pump 25 is integrally provided on the bottom wall 59 of the oil pan body $14_1$ at a location near the opening 51 of the oil pan chamber $C_O$, and the oil pump 25 is fastened on the mounting seat 75 at points corresponding to apexes of a triangle on the mounting seat 75 by three bolts $76_1$, $76_2$ and $76_3$.

The fastening positions of the bolts $76_1$, $76_2$ and $76_3$ are determined as locations between the first and second bearing cap sections $17_1$ and $17_2$ and between the second and third bearing cap sections $17_2$ and $17_3$. The mountability of the oil pump 25 on the mounting seat 75 is enhanced by determining the fastening positions of the bolts $76_1$, $76_2$ and $76_3$ in the above manner.

The position of mounting of the oil pump 25 on the bottom wall 59 is determined at a location near the opening 51. In this embodiment, the location near the opening 51 is determined as being near to the opening 51 from the third bearing cap section $17_3$ located at the substantially axially central portion of the crankshaft 18, but preferably, it is desirable that the location near the opening 51 is determined as being closer to the opening 51 than the third bearing cap section $17_3$, i.e., from the second bearing cap section $17_2$.

Figure 12:
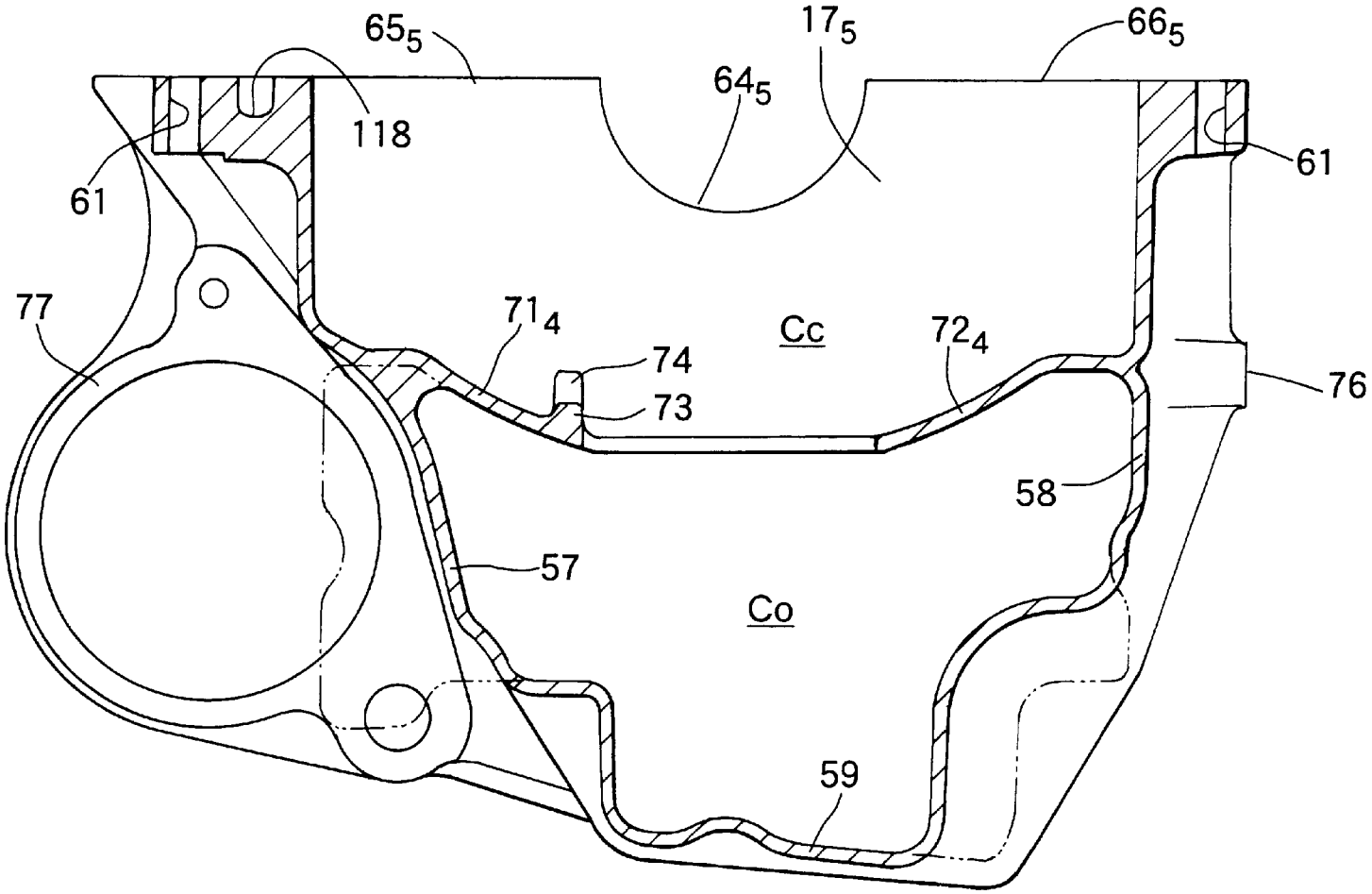
Figure 13:
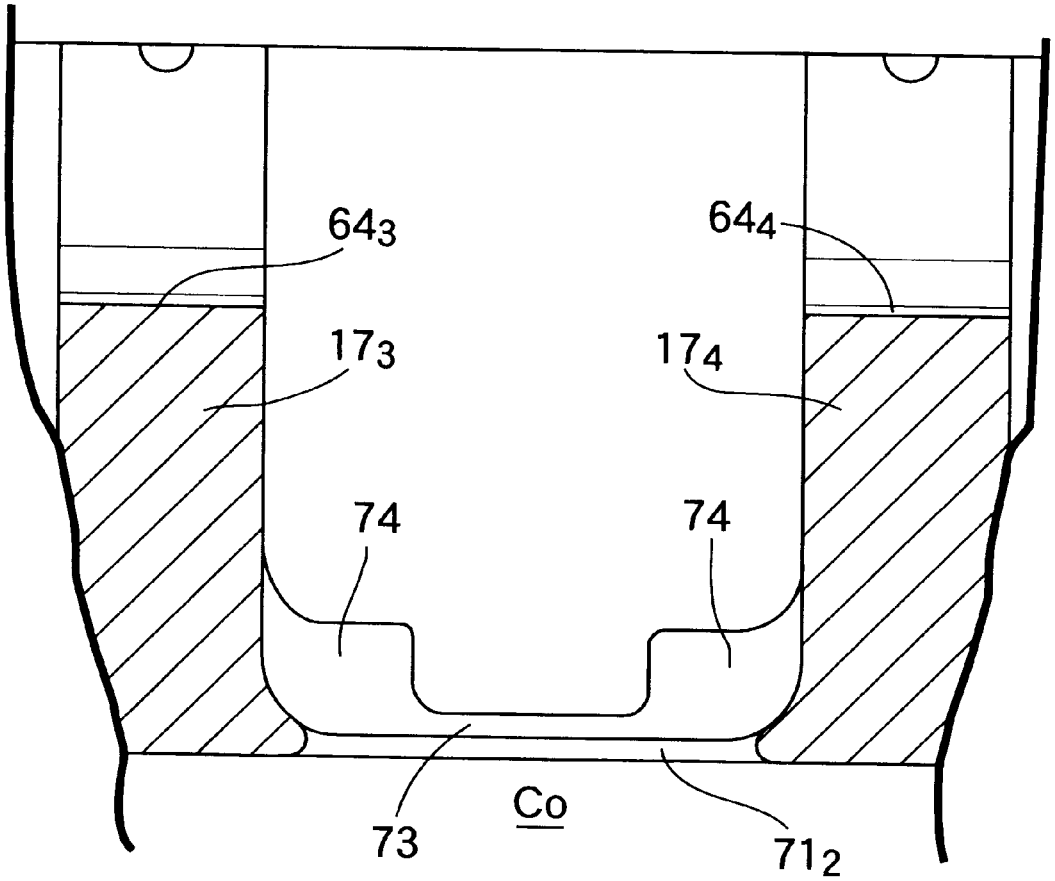

A starter mounting seat 77 is integrally formed on the left sidewall 57 at a location near the end wall 60 of the oil pan body $14_1$ and extends between the oil pan chamber $C_O$ and the crank chamber $C_C$, as shown in FIG. 12, and a starter (not shown) for starting the engine is mounted on the starter mounting seat 77.

Boss-like thick mounting portions 76 are integrally provided in an outward directed fashion on an outer surface of one of the two sidewalls of the oil pan 14, e.g., on an outer surface of the right sidewall 58 of the oil pan body $14_1$ corresponding to the second and fourth bearing cap sections $17_2$ and $17_4$ in this embodiment. The intake manifold 35 as an intake system member is secured at its lower portion to the mounting portions 76 by fixtures 77 such as bolts. In place of the intake manifold 35, the intake system member may be any of a throttle body, an intake duct, an intake chamber and an air cleaner and the like.

Figure 3:
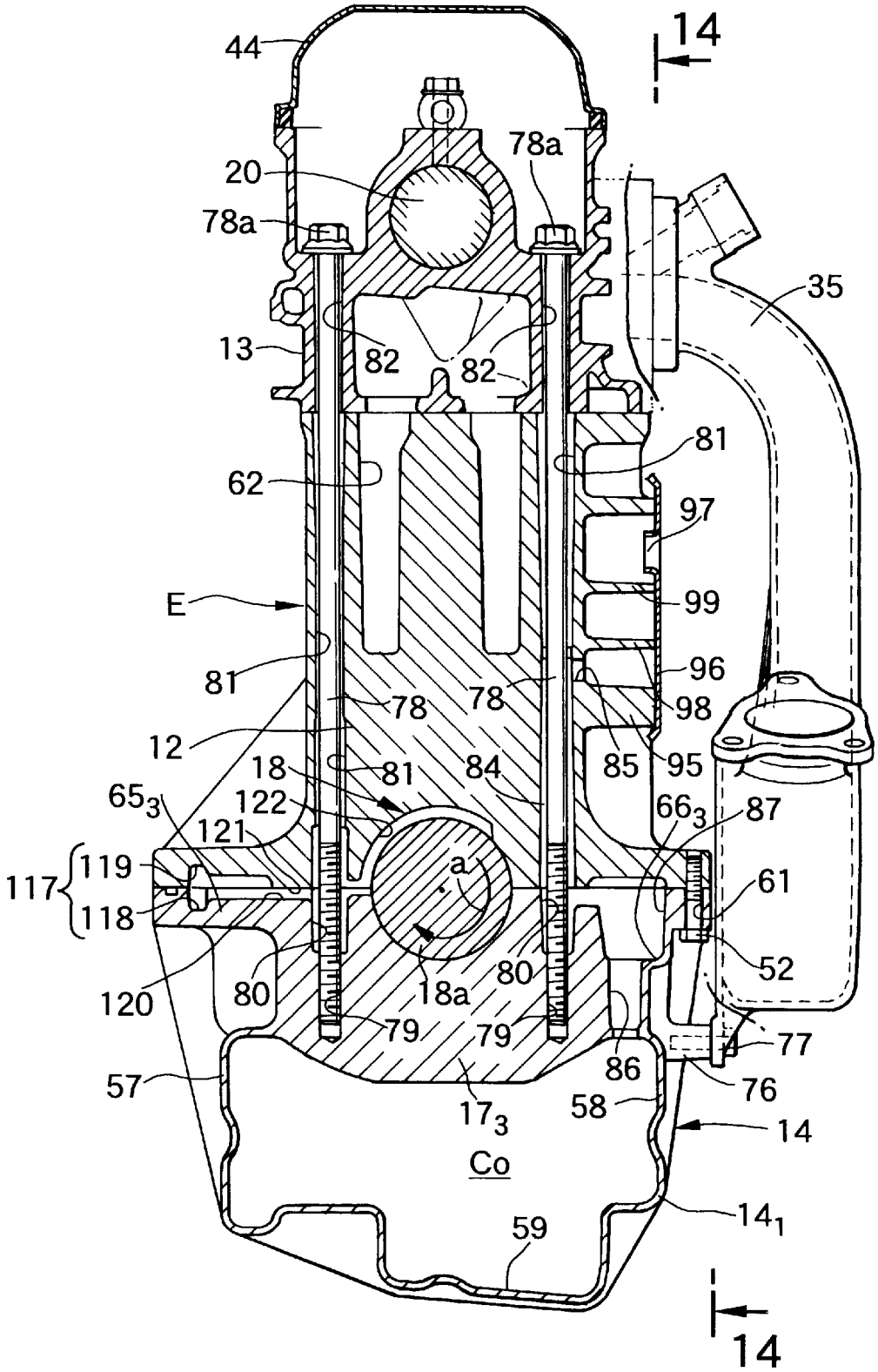
Figure 4:
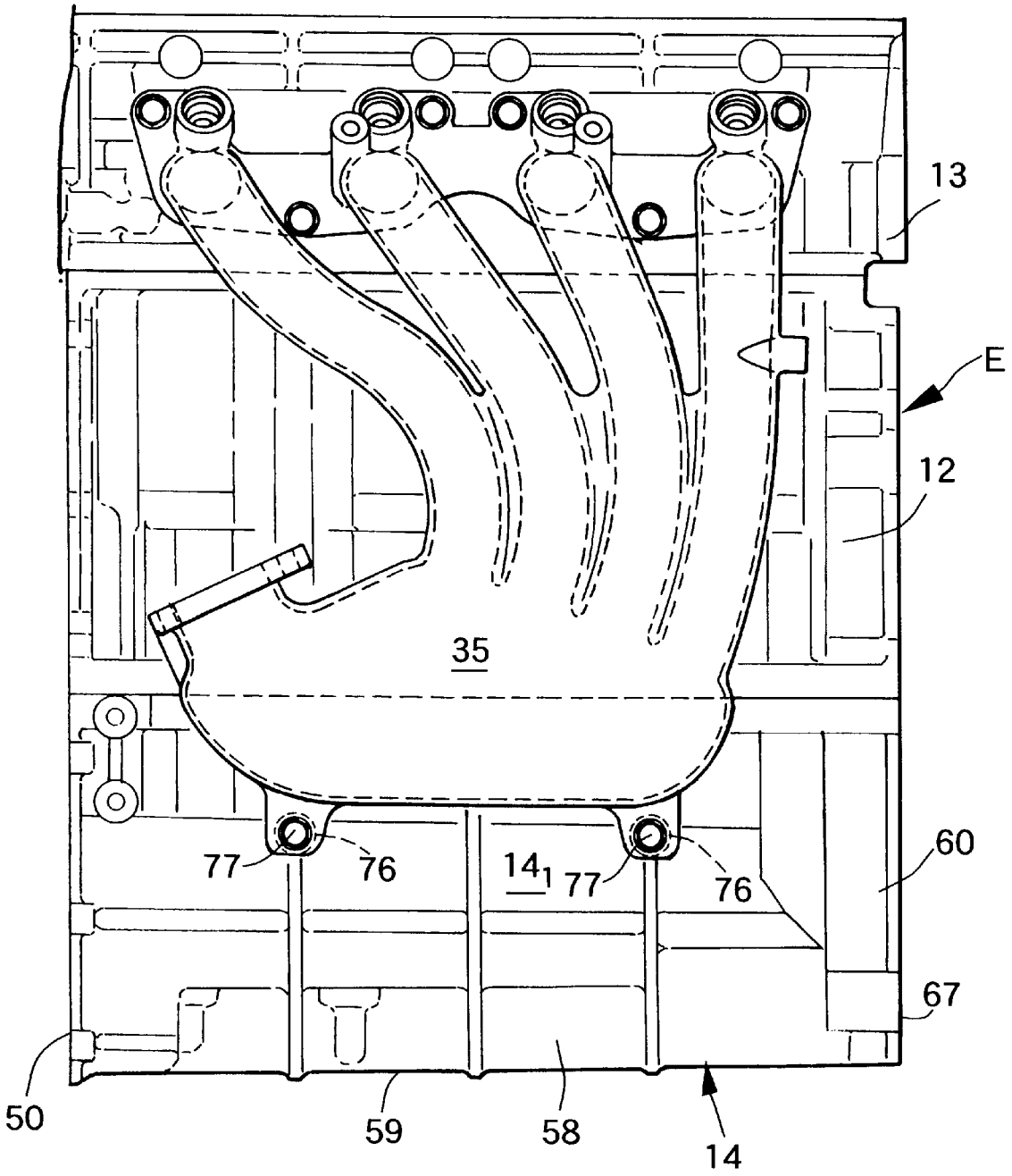

Referring especially to FIG. 3, each of the bearing cap sections $17_1$, $17_2$, $17_3$, $17_4$ and $17_5$ in the oil pan body $14_1$ is provided at its opposite sides with a plurality of bottomed threaded bores 79, into which through bolts 78 are screwed for fastening the cylinder block 12, between the cylinder head 13 and the bearing cap sections $17_1$, $17_2$, $17_3$, $17_4$ and $17_5$. Each of the bearing cap sections $17_1$, $17_2$, $17_3$, $17_4$ and $17_5$ in the oil pan body $14_1$ is also provided at its opposite sides with a plurality of recesses 80 which are coaxially aligned with the threaded bores 79 with a diameter larger than that of the threaded bores 79 and which have upper ends opened.

The cylinder block 12 has a plurality of bolt insertion bores 81 provided therein in correspondence to the threaded bores 79 and the recesses 80 to extend vertically outside the water jacket 62. The inside diameter of the bolt insertion bores 81 is determined at a value enabling an annular void to be created between the inside diameter and the outside diameter of the through bolts 78. Moreover, the bolt insertion bores 81 are made as cast from vertically opposite ends of the cylinder block 12, when the cylinder block 12 is formed by a casting process. Each of the bolt insertion bores 81 is made so that the diameter thereof is decreased from the axially opposite ends toward the axially central portion. The axially central portion of each of the bolt insertion bores 81 is at a location substantially corresponding to a bottom of the water jacket 62 provided in the cylinder block 12. Therefore, by the fact that the axially central portion of each of the bolt insertion bores 81 is formed at a smaller diameter, the bottom of the water jacket 62 does not have to be reduced in rigidity.

Further, bolt insertion bores 82 corresponding to the bolt insertion bores 81 in the cylinder block 12 are provided in the cylinder head 13 to extend vertically and are made as cast from the top to the bottom of the cylinder head 13, when the cylinder head 13 is formed by a casting process. The bolt insertion bores 82 are made so that the diameter thereof is decreased toward the lower portion.

The through bolts 78 are screwed from above the cylinder head 13, through the bolt insertion bores 82 and 81 and the recesses 80, into the threaded bores 79. Thus, the cylinder head 13 and the bearing cap sections $\mathbf{17}_1$, $\mathbf{17}_2$, $\mathbf{17}_3$, $\mathbf{17}_4$ and $\mathbf{17}_5$ with the cylinder block 12 therebetween, are integrally fastened together by screwing of the through bolts 78 until locking heads 78*a* at their upper ends engage the upper surface of the cylinder head 13.

The annular void defined between the through bolt 78 screwed into a portion of the third bearing cap section $\mathbf{17}_3$ on the side of the right sidewall 58, and the bolt insertion bore 81 in the cylinder block 12, functions as an oil return passage 84. A return bore 85 leading to the oil return passage 84 is provided at a vertically intermediate portion of the cylinder block 12 in such a manner that it opens into an outer surface of the cylinder block on the side of the intake manifold 35 (see a right portion of FIG. 3).

The connecting wall $\mathbf{66}_3$ integrally connecting the third bearing cap section $\mathbf{17}_3$ with the right sidewall 58 of the oil pan body $\mathbf{14}_1$ is provided with an oil escape passage 86 extending in a direction parallel to an axis of the through bolt 78. An oil escape groove 87 connecting the oil return passage 84 with the oil escape passage 86, is defined in at least one of the mating faces of the third bearing cap section $\mathbf{17}_3$ and the connecting wall $\mathbf{66}_3$ with the cylinder block 12, e.g., in the mating faces of both of the third bearing cap section $\mathbf{17}_3$ and the connecting wall $\mathbf{66}_3$ with the cylinder block 12 in this embodiment. Therefore, oil dropping down within the oil return passage 84 is returned into the oil pan 14 via the oil escape groove 87 through the oil escape passage 86.

Figure 14:
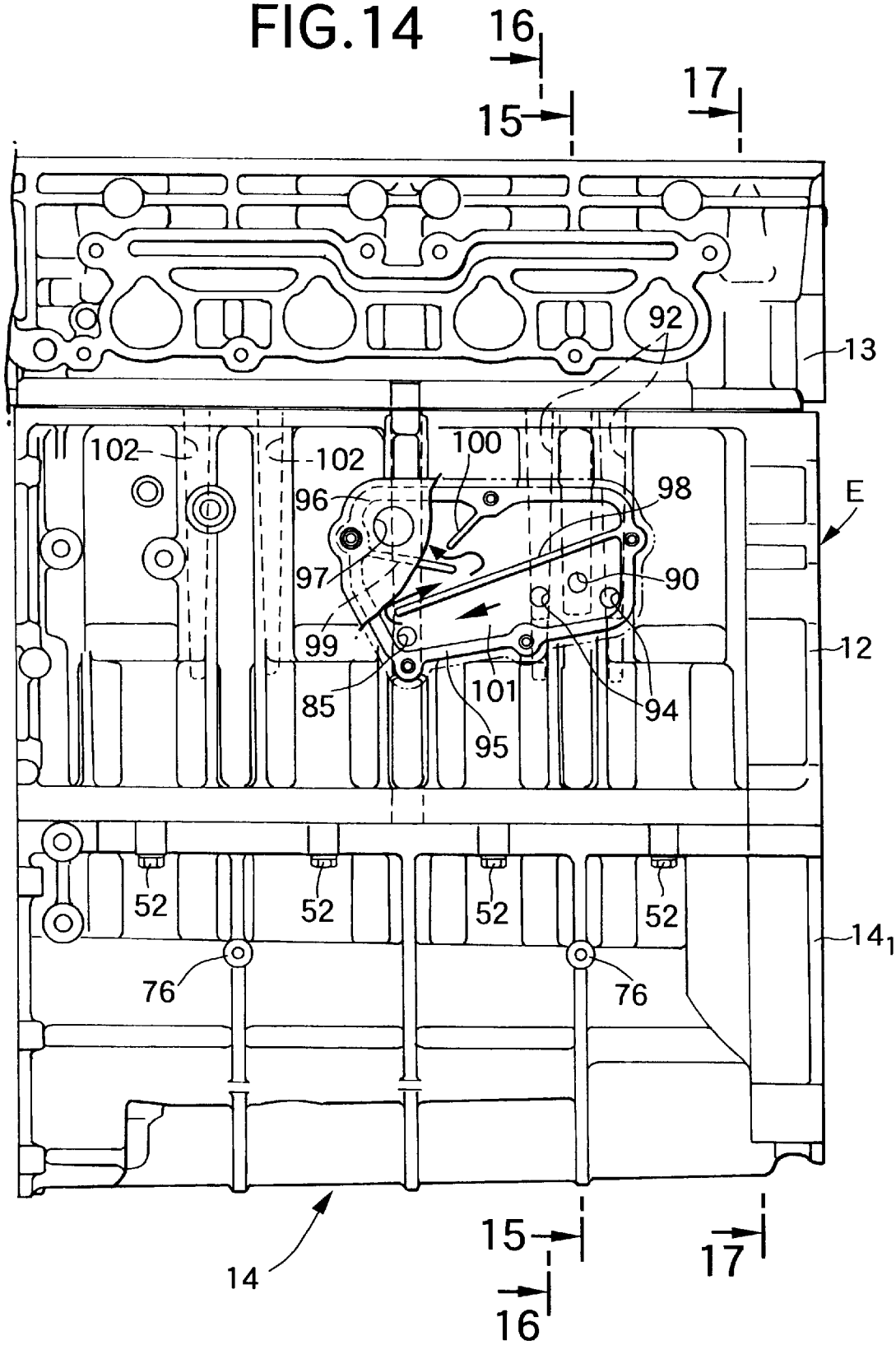
Figure 15:
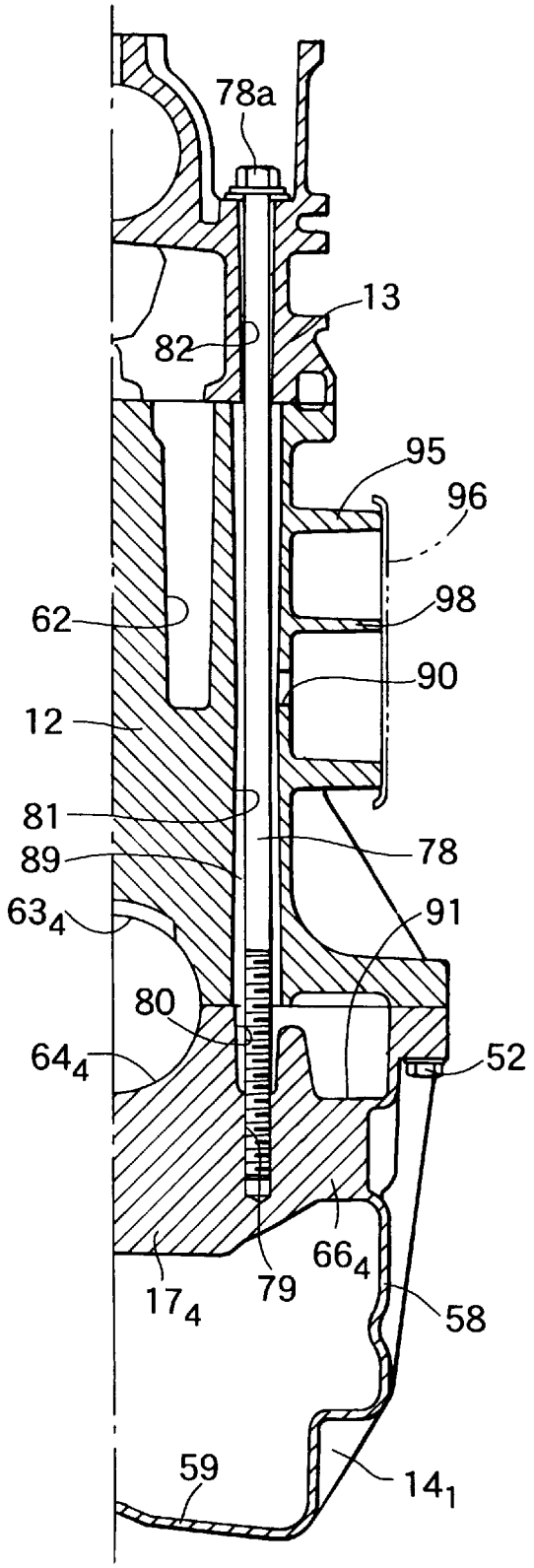

Referring also to FIGS. 14 and 15, the annular void defined between the through bolt 78 screwed into a portion of the fourth bearing cap section $\mathbf{17}_4$ on the side of the right side wall 58 and the bolt insertion bore 81 in the cylinder block 12 functions as a blow-by gas passage 89. A discharge bore 90 leading to the blow-by gas passage 89 is provided in a vertically intermediate portion of the cylinder block 12 in such a manner that it opens into the outer surface of the cylinder block 12 at a location substantially corresponding to the axially central portion of the bolt insertion bore 81 and higher in level than the return bore 85. A notch 91 is provided at an upper end of the connecting wall $\mathbf{66}_4$ which integrally interconnects the fourth bearing cap section $\mathbf{17}_4$ and the right sidewall 58 of the oil pan body $\mathbf{14}_1$, so that a blow-by gas can be guided from opposite sides of the fourth bearing cap section $\mathbf{17}_4$ into the blow-by gas passage 89.

Figure 16:
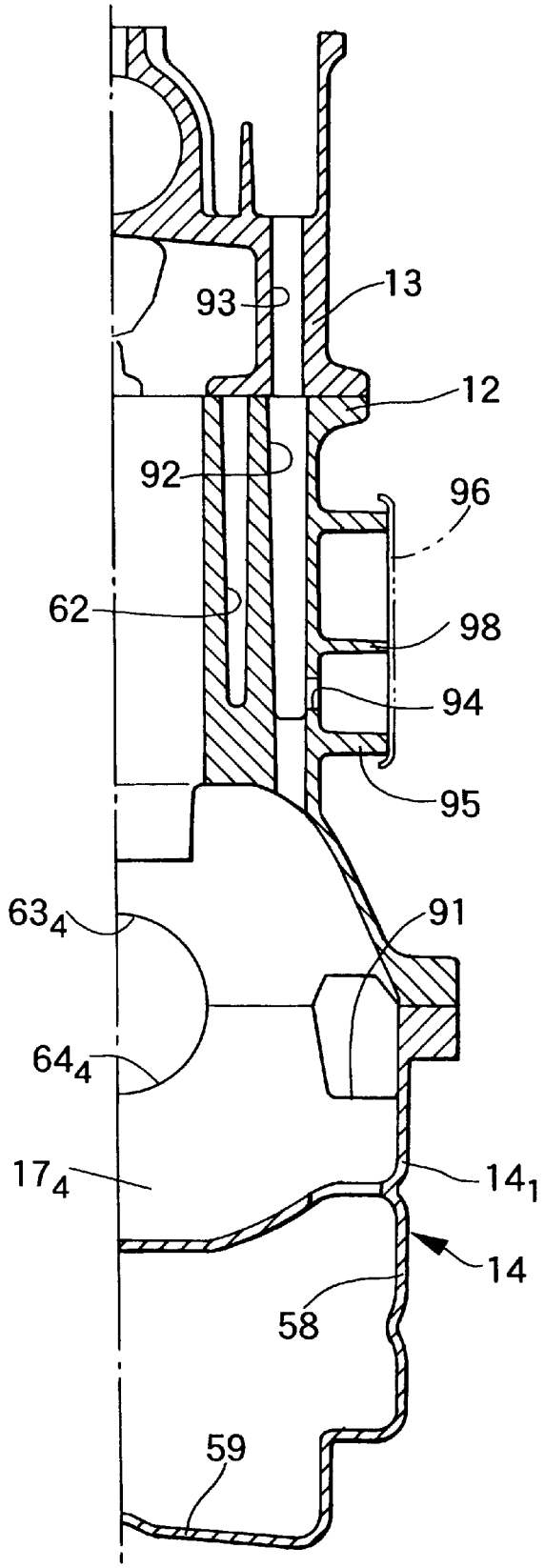

Referring also to FIG. 16, vertically extending blow-by gas passages 92 with their lower ends opened, are provided in the cylinder block 12 on opposite sides of the blow-by gas passage 89. Vertically extending blow-by gas passages 93 with their upper end opened, are provided in the cylinder head 13, and are coaxially connected to upper ends of the blow-by gas passages 92. Moreover, discharge bores 94 are provided in the vertically intermediate portion of the cylinder block 12 in such a manner that they open into the outer surface of the cylinder block 12 on opposite sides of the discharge bores 90.

A wall 95 is integrally provided in an outward protruding manner on an outer surface of the vertically intermediate portion of the cylinder block 12 on the side of the intake manifold 35 in an area corresponding to the third and fourth bearing cap sections $\mathbf{17}_3$ and $\mathbf{17}_4$. The wall 95 extends in an endless manner to surround opened ends of the return bore 85 and the discharge bores 90 and 94. A lid plate 96 is fastened to an outer end of the wall 95, and as shown in FIGS. 3 and 14, an opening 97 is provided in the lid plate 96 at a location above the return bore 85. Partition walls 98, 99 and 100 are integrally provided in a protruding manner, with their outer ends contacting the lid plate 96, on the outer surface of the cylinder block 12 in an area surrounded by the wall 95. A blow-by gas flow path 101 extending from the discharge bores 90 and 94 to the opening 97 is defined as a labyrinth by the partition walls 98, 99 and 100, as shown by an arrow in FIG. 14. The return bore 85 is provided in the cylinder block 12 i n such a manner that it is located at a lowermost portion of the flow path 101. Moreover, the opening 97 in the lid plate 96 is connected to the intake manifold 35 through a pipe line (not shown).

Therefore, the oil entrained in the blow-by gas flowing from the blow-by gas passages 89 and 92 via the discharge bores 90 and 94 into the flow path 101, is separated from the blow-by gas while the blow-by gas is flowing in the flow path 101 which is the labyrinth. The separated oil is passed along the inner surface of the wall 95 and the partition walls 98, 99 and 100 into the return bore 85 and further from the return bore 85 into the oil return passage 84. Moreover, the blow-by gas passage 89 is formed so that the flow area is gradually decreased from its lower portion to a location substantially corresponding to its axially intermediate portion, i.e., the discharge bore 90. The effect of separation of the oil from the blow-by gas in the flow path 101 can be enhanced by a constricting effect in a zone substantially corresponding to the portion having a minimum flow area, i.e., the discharge bore 90, and an expanding effect provided when the oil has passed from the discharge bore 90 to the flow path 101.

As shown by a dashed line in FIG. 14, blow-by gas passages 102 extending vertically with their lower ends opened, are provided in the cylinder block 12 even in an area corresponding to the second bearing cap section $\mathbf{17}_2$. Blow-by gas passages (not shown) extending upwards with their upper ends opened are provided in the cylinder head 13 and coaxially connected to upper ends of the blow-by gas passages 102. The blow-by gas passages 102 only function to permit the blow-by gas to flow therethrough from below the cylinder block 12 to above the cylinder head 13.

Figure 17:
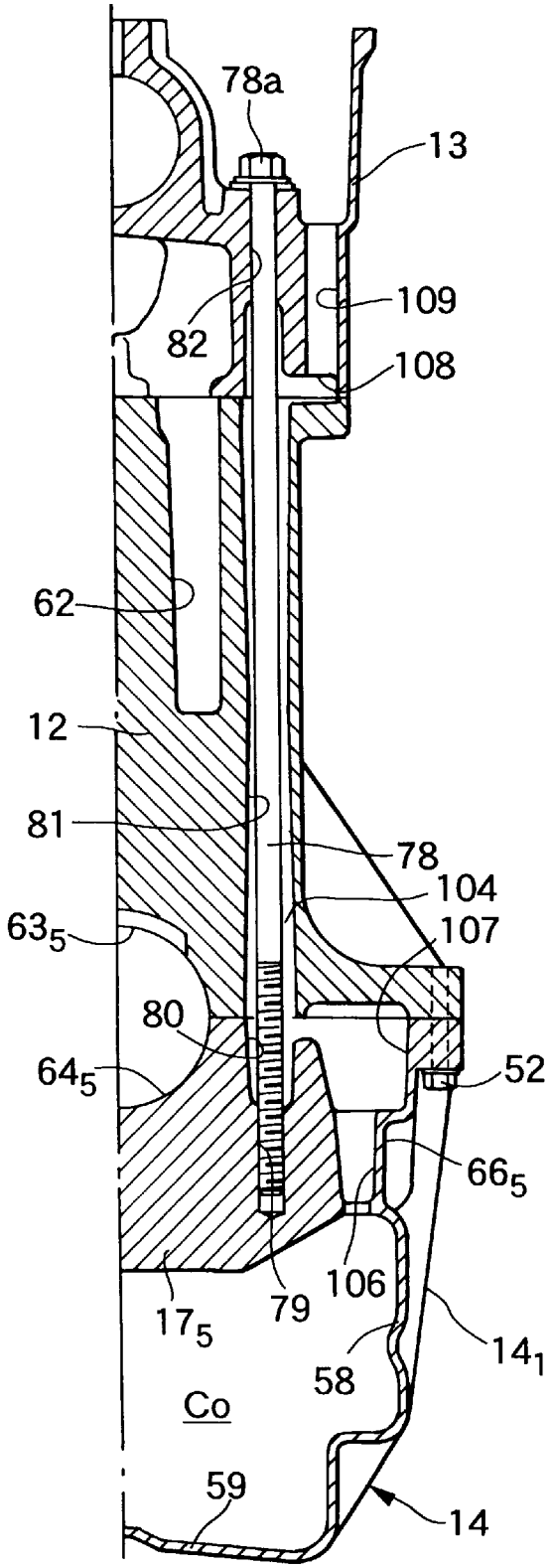

Referring to FIG. 17, the annular void between the through bolt 78 screwed into a portion of the fifth bearing cap section $17_5$ on the side of the right sidewall 58 and the bolt insertion bore 81 in the cylinder block 12 functions as an oil return passage 104. An oil escape passage 106 is provided in the connecting wall $66_5$ integrally interconnecting the fifth bearing cap section $17_5$ and the right sidewall 58 of the oil pan body $14_1$, and extends in a direction parallel to the axis of the through bolt 78. An oil escape groove 107 connecting a lower end of the oil return passage 104 with the oil escape passage 106 is defined in at least one of the mating faces of the connecting wall $66_5$ and the fifth bearing cap section $17_5$ with the cylinder block 12, e.g., in the mating faces of both of the fifth bearing cap section $17_5$ and the connecting wall $66_5$ with the cylinder block 12 in this embodiment. Therefore, the oil dropping down within the oil return passage 104 is returned into oil pan 14 via the oil escape groove 107 through the oil escape passage 106.

A groove 108 is provided in a mating face of the cylinder head 13 with the cylinder block 12, and leads at one end to the upper end of the oil return passage 104. An oil passage 109 extending upwards, is provided in the cylinder head 13 with its upper end open and with its lower end leading to the other end of the groove 108. Thus, the oil accumulated in the cylinder head 13 is passed from the oil passage 109 through the groove 108 to the upper end of the oil return passage 104.

The annular void defined between the through bolt 78 screwed into a portion of the first bearing cap section $17_1$ on the right sidewall 58 and the bolt insertion bore 81 in the cylinder block 12 functions as an oil return passage (not shown) for permitting the oil to be returned from the cylinder head 13 as in the oil return passage 104 in the area corresponding to the fifth bearing cap section $17_5$. An oil escape passage 106' extending in a direction parallel to the axis of the through bolt 78, is provided in the connecting wall $66_1$ which interconnects the first bearing cap section $17_1$ and the right sidewall 58 of the oil pan body $14_1$. An oil escape groove 107' is provided in at least one of mating faces of both of the first bearing cap section $17_1$ and the connecting wall $66_1$ with the cylinder block 12, e.g., in the mating faces of both of the first bearing cap section $17_1$ and the connecting wall $66_1$ with the cylinder block 12 in this embodiment.

Figure 18:
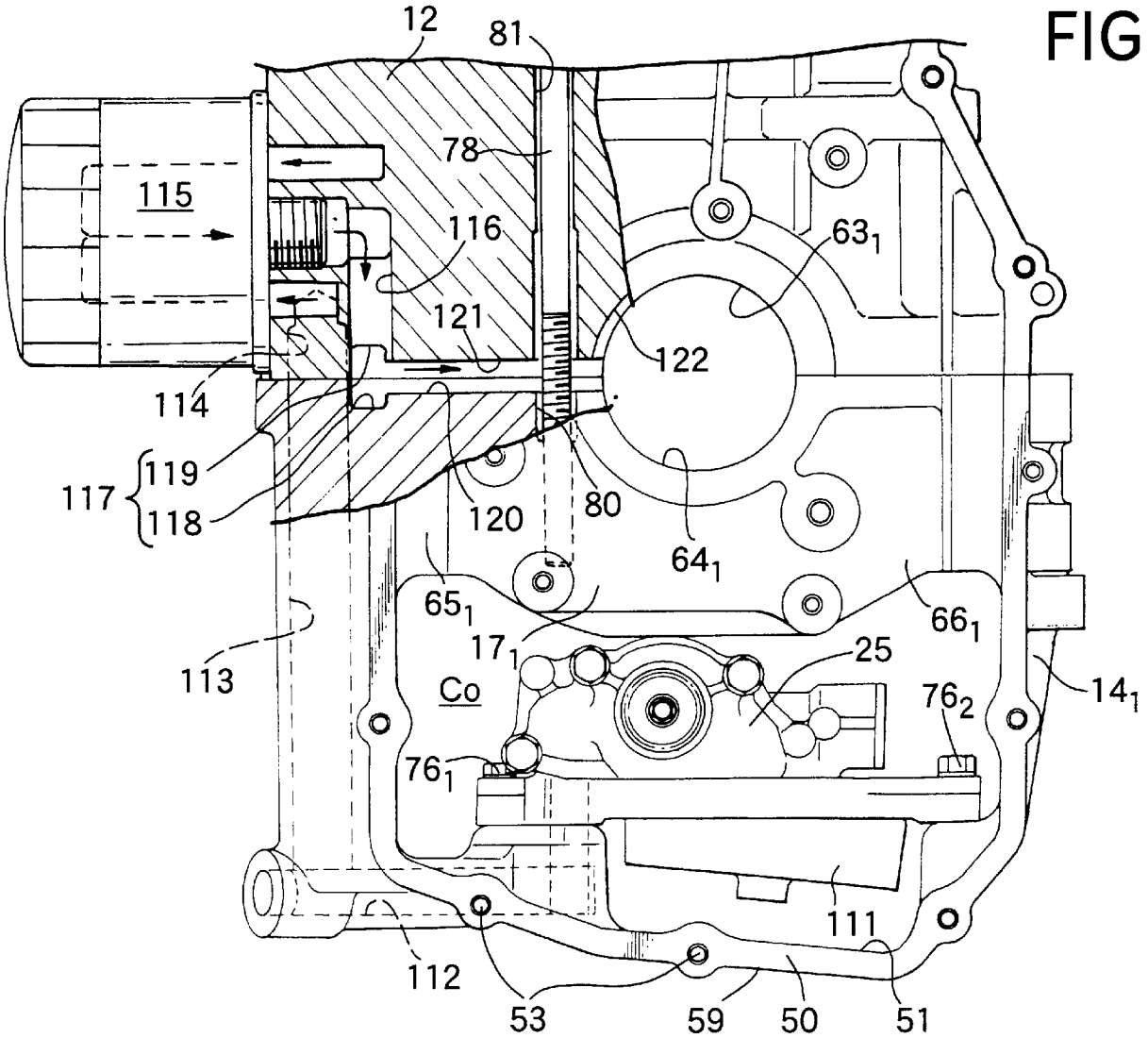

Referring to FIG. 18, the oil pump 25 is fixed to the mounting seat 75 on the bottom of the oil pan body $14_1$ at a location substantially below the first bearing cap section $17_1$, and an oil strainer 111 is connected to the lower portion of the oil pump 25. An oil supply passage 112 is integrally provided in the bottom wall 59 of the oil pan body $14_1$ to lead to the discharge port of the oil pump 25, and communicates with a lower end of an oil supply passage 113 which extends vertically within the left sidewall 57 in the oil pan body $14_1$. An oil supply passage 114 is provided in the cylinder block 12 to lead to an upper end of the oil supply passage 113, and oil filter 115 is mounted on the cylinder block 12 and connected to the oil supply passage 114. Thus, the oil resulting from the purification in the oil filter 115 is supplied via an oil supply passage 116 provided in the cylinder block 12 to a main gallery 117.

The oil filter 115 is mounted on the cylinder block 12 in the vicinity of the mating face between the cylinder block 12 and the oil pan 14. Thus, because the rigidity of the cylinder block 12 at the mating face is relatively high, the mounting rigidity of the oil filter 115 can be enhanced, and the oil supply passage 116 interconnecting the oil supply passage 113 for passing the oil from the oil pump 25 to the oil filter 115 as well as the main gallery 117 defined in the mating face and the oil filter 115 can be relatively shortened.

The main gallery 117 is defined in mating faces of the left sidewall 57 of the oil pan body $14_1$ and the cylinder block 12 to extend in the axial direction of the crankshaft 18. The main gallery 117 is defined by a groove 118 provided in the mating face of the left sidewall 57 with the cylinder block 12 and a groove 119 provided in the mating face of the cylinder block 12 with the left sidewall 57.

Oil supply grooves 120 with one end communicating with the main gallery 117 and with the other end opening into the lower halves $64_1$ to $64_5$ of the bearing sections are defined in the mating faces of the connecting walls $65_1$ to $65_5$ integrally interconnecting the bearing cap sections $17_1$ to $17_5$ and the left sidewall 57 as well as the bearing cap sections $17_1$ to $17_5$ with the cylinder block 12, in order to supply the oil to the crank journal portions 18*a* of the crankshaft 18. Oil supply grooves 121 corresponding to the oil supply grooves 120 are defined in mating faces of the cylinder block 12 with the connecting walls $65_1$ to $65_5$ and the bearing cap sections $17_1$ to $17_5$, to extend between the main gallery 117 and the upper halves $63_1$ to $63_5$ of the bearing cap sections.

Further, recesses 122 are provided in the inner peripheral surfaces of the upper halves $63_1$ to $63_5$ to lead the oil supply grooves 121, respectively, so that the lubrication of the crank journals 118*a* of the crankshaft 18 is performed by the oil accumulated in each of the recesses 122.

The oil supply grooves 120 and 121 lead to the recesses 80 which are provided in the bearing cap sections $17_1$ to $17_5$ and are coaxially connected to the threaded bores 79 provided in the portions of the bearing cap sections $17_1$ to $17_5$ on the side of the left sidewall 57 to permit the through bolts 78 screwed in the threaded bores 79, to be inserted therethrough. Therefore, the main gallery 117 leads through the oil supply grooves 120 and 121 to the annular voids between the through bolts 78 and the bolt insertion bores 81 provided in the cylinder block 12 to permit the through bolts 78 screwed in the portions of the threaded bores 79 provided in the portions of the bearing cap sections $17_1$ to $17_5$ on the side of the left sidewall 57 to be inserted therethrough. Thus, the annular void between the bolt 78 screwed in the portion of the first bearing cap section $17_1$ on the side of the left sidewall 57 and the bolt insertion bore 81 in the cylinder block 12, functions as an oil passage for permitting the oil from the main gallery 117 to be passed, for example, to a tensioner (not shown) for providing a given tension to the timing chain 23 of the timing transmitting mechanism 24. The annular void defined between the through bolt 78 screwed in the portion of the fifth bearing cap section $17_5$ on the side of left sidewall 57 and the bolt insertion bore 81 in the cylinder block 12, functions as an oil passage for permitting the oil from the main gallery 117 to be passed, for example, to the valve operating mechanism 43.

In such an engine for the vehicle, to couple the cylinder block 12 of the engine body E and the oil pan 14 to each other, the plurality of through bolts 78 from the cylinder block 12 are screwed into the plurality of threaded bores 79 provided in the bearing cap sections $17_1$ to $17_5$ included in the oil pan body $14_1$ of the oil pan 14. Therefore, portions protruding downwards from the lower surfaces of the bearing cap sections $17_1$ to $17_5$ can be eliminated. Thus, when the oil pan body $14_1$ is produced by the casting process, the oil pan chamber $C_O$ extending in the direction parallel to the arrangement of the bearing cap sections $17_1$ to $17_5$ below the bearing cap sections $17_1$ to $17_5$, can be simultaneously made as the as-cast bore extending in the axial direction of the crankshaft 18, by drawing of the forming mold such as the core, and it is easy to form the oil pan body $14_1$ and particularly, the oil pan chamber $C_O$. This makes it possible to reduce the molding cost, and also contributes to a reduction in weight in the oil pan 14 itself. Further, this facilitates the ensuring of the capacity of the oil pan chamber $C_O$ and enables a reduction in size of the oil pan 14 itself.

In addition, since it is unnecessary to make mounting bores such as bolt bores in the bottom wall 59 of the oil pan body $\mathbf{14}_1$, a sealing means for preventing the leakage of the lubricating oil is not required, which makes it possible to reduce the number of parts and reduce the weight and ensure the volume of the lubricating oil. Additionally, the required rigidity of the oil pan 14 itself is ensured.

Moreover, the through bolts 78 integrally fasten the cylinder block 12, the cylinder head 13 above the cylinder block 12 and the bearing cap sections $\mathbf{17}_1$ to $\mathbf{17}_5$ of the oil pan 14 to one another, and hence, the cylinder block 12, the cylinder head 13 above the cylinder block 12 and the oil pan 14 can be firmly fastened together from above the cylinder head 13 without use of connecting bolts passing through the oil pan chamber $C_O$. In addition, since the threaded bores 79 for insertion of the through bolts 78 are bottomed, the lower surfaces of the bearing cap sections $\mathbf{17}_1$ to $\mathbf{17}_5$ can be formed into unroughened, smooth surfaces, and it is possible to further facilitate the as-cast formation of the oil pan chamber $C_O$.

The adjacent bearing cap sections $\mathbf{17}_1$, $\mathbf{17}_2$, $\mathbf{17}_3$, $\mathbf{17}_4$, $\mathbf{17}_5$ are integrally connected to each other by the baffle plates $\mathbf{71}_1$, $\mathbf{71}_2$, $\mathbf{71}_3$, $\mathbf{71}_4$, $\mathbf{72}_1$, $\mathbf{72}_2$, $\mathbf{72}_3$, $\mathbf{72}_4$ partitioning the crank chamber $C_C$ and the oil pan chamber $C_O$ and the reinforcing walls 73 extending in the axial direction of the crankshaft 18. This makes it possible to remarkably enhance the rigidity of the oil pan 14 and further, the bearing cap sections $\mathbf{17}_1$, $\mathbf{17}_2$, $\mathbf{17}_3$, $\mathbf{17}_4$ and $\mathbf{17}_5$ and inhibit the splashing-up of the lubricating oil within the oil pan chamber $C_O$ into the crank chamber $C_C$.

Further, since the thick mounting portions 76 for mounting of the intake manifold 35 are integrally formed on the outer surface of the right sidewall 58 included in the oil pan body $\mathbf{14}_1$, the rigidity of supporting of the members forming the intake system can be enhanced, and the rigidity of the oil pan 14 itself and the bearing cap sections $\mathbf{17}_1$ to $\mathbf{17}_5$ can be further enhanced.

The oil pan 14 is comprised of the oil pan body $\mathbf{14}_1$ coupled to the cylinder block 12, and the extension 45*a* included in the transmitting case 45 covering the timing transmitting mechanism 24 and the power transmitting means 29. Therefore, it is possible to provide an oil pan 14 which ensures a required sufficient amount of the lubricating oil, while providing a reduction in size of the oil pan body $\mathbf{14}_1$. The extension 45*a* is formed protruding outwards to occupy dead space below the driving pulley 47. This ensures that the dead space below the driving pulley 47 can be effectively utilized, and the engine body E itself is not increased in size, and this contributes to the protection of the driving pulley 47 and the endless transmitting band 48. Particularly, the extension 45*a* protruding outwards beyond the axial width of the driving pulley 47 ensures the excellent protection of the driving pulley 47 and the endless transmitting band 48.

The inner surface of the bottom wall 49 of the oil pan body $\mathbf{14}_1$ is formed as the slant having a downward gradient toward the opening 51 of the oil pan chamber $C_O$, and the oil discharge port 69 is provided at a lowermost portion of the extension 45*a* which is the lid for closing the opening 51. Therefore, it is possible to facilitate the operation for withdrawing the lubricating oil within the oil pan 14, and also the lubricating oil does not remain in the oil pan 14. Further, the oil discharge port 69 is bored in the boss portion 68 provided in the extension 45*a*, and the rigidity of the transmitting case 45 itself is not reduced in spite of formation of the oil discharged port 69.

Yet further, the oil pump 25 is mounted on the bottom wall 59 of the oil pan body $\mathbf{14}_1$ within the oil pan chamber $C_O$ through the opening 51 of the oil pan chamber $C_O$ and hence, the oil pump 25 can be easily assembled within the oil pan chamber $C_O$, leading to an enhanced assemblability. Moreover, the oil pan chamber $C_O$ is divergent toward the opening 51 and hence, the oil pump 25 is placed into the oil pan chamber $C_O$ through the opening 51 having a larger open area in a direction perpendicular to the axis of the crankshaft 18, leading further to the easy assembling of the oil pump 25 into the oil pan chamber $C_O$. Further, the oil pump 25 is mounted on the mounting seat 75 provided on the bottom wall 59 at the location closer to the opening 51, and the oil supply passage 112 is integrally defined in the bottom wall 59. Therefore, the configuration of the passageway extending from the oil pump 25 to the oil supply system in the cylinder block 12 is remarkably simplified, and the oil pan 14 can be formed with a high rigidity over its entire area in such a manner that the oil pan body $\mathbf{14}_1$ is reinforced in rigidity on the side of the opening 51.

The opening 51 is closed by the extension 45*a* which is the lid. Therefore, notwithstanding that the oil pan 14 is of the bearing cap-integral type including the bearing cap sections $\mathbf{17}_1$ to $\mathbf{17}_5$ integrally provided therein, the mounting of the oil pump 25 in the oil pan 14 and the maintenance of the oil pump after being mounted are facilitated, and also the position of mounting of the oil pump 25 is not limited.

In addition, annular voids are defined between the inner surfaces of the bolt insertion bores 81 provided in the cylinder block 12 and the through bolts 78 inserted through the bolt insertion bores 81, wherein (1) the annular void defined between the bolt insertion bore 81 and the through bolt 78 screwed in the portion of the first bearing cap section $\mathbf{17}_1$, on the side of the right sidewall 58, (2) the annular void defined between the bolt insertion bore 81 and the through bolt 78 screwed in the portion of the third bearing cap section $\mathbf{17}_3$ on the side of the right sidewall 58, and (3) the annular void defined between the bolt insertion bore 81 and the through bolt 78 screwed in the portion of the fifth bearing cap section $\mathbf{17}_5$ on the side of the right sidewall 58, are used as the oil return passages 84 and 104. Therefore, it is unnecessary to especially ensure a space for defining the oil return passages 84 and 104 in the cylinder block 12 and hence, it is possible to reduce the size of the cylinder block by an amount corresponding to such unnecessary space, and the configuration of the oil return passages 84 and 104 can be simplified.

The annular void defined between the bolt insertion bore 81 and the through bolt 78 screwed in the portion of the fourth bearing cap section $\mathbf{17}_4$ on the side of the right sidewall 58 is used as the blow-by gas passage 89. Therefore, the deficiency of the flow areas of the blow-by gas passages 92 and 102 provided in the cylinder block 12 can be compensated by the blow-bay gas passage 89 between the through bolt 78 and the bolt insertion bore 81, the space required for the blow-by gas passages 92 and 102 made in the cylinder block by drilling can be reduced to be a relatively small and thus, the size of the cylinder block 12 can be reduced by an amount corresponding the relatively small extent.

The oil dropping down within the oil return passages 84 and 104 is returned to the oil pan 14 via the oil escape grooves 107', 87 and 107 defined in the mating faces of the connecting walls $66_1$, $66_3$ and $66_5$ integrally interconnecting the first, third and fifth bearing cap sections $17_1$, $17_3$ and $17_5$ and the right sidewall 57 with the cylinder block 12 and through the oil escape passages 106', 86 and 106 provided in the connecting walls $66_1$, $66_3$ and $66_5$. Therefore, the oil can be returned into the oil pan 14 in such a manner that it is kept out of a counterweight of the crankshaft 18 located adjacent the bearing cap sections $17_1$, $17_3$ and $17_5$ in the axial direction of the crankshaft 18. Thus, the oil can be quickly returned into the oil pan 14, and an increase in loss of the rotational power of the crankshaft 18 due to the deposition of the oil onto the counterweight can be avoided. Moreover, the oil escape passages 106', 86 and 106 are not provided in the bearing cap sections $17_1$, $17_3$ and $17_5$ and hence, the rigidity of the bearing cap sections $17_1$, $17_3$ and $17_5$ is not decreased due to the formation of the oil escape passages 106', 86 and 106.

Further, the main gallery 117 extending in the axial direction of the crankshaft 18 is defined in the mating faces of the oil pan 14 and the cylinder block 12 with each other, and the oil supply grooves 120 and 121 for supplying the oil to the crank journal portions 18*a* of the crankshaft 18 are defined in at least one of the mating faces of the bearing cap sections $17_1$ to $17_5$ and the connecting walls $65_1$, to $65_5$ with the cylinder block 12, e.g., in both in this embodiment, in such a manner that they lead to the main gallery 117. Therefore, it is possible to simplify the configuration of the oil passageway for supplying the oil to the crank journal portions 18*a* of the crankshaft 18.

Moreover, some of the annular voids defined between the bolt insertion bores 81 and the through bolts 78 screwed into the portions of the bearing cap sections $17_1$ to $17_5$ on the side of the left sidewall 57 are used as the oil passages for passing oil from the main gallery 117. Thus, it is unnecessary to provided special oil passages in the cylinder block 12, and it is possible to provide a simplification of the configuration of the oil passageway and a further reduction in size of the cylinder block 12.

The present invention has been described by way of the embodiment applied to the serial 4-cylinder engine, but the present invention is also applicable to another type of engine, such as a multi-cylinder or a single-cylinder engine. The chain transmitting mechanism has been employed as the timing transmitting mechanism 24 for operating the crankshaft 18 and the valve operating cam shaft 20 in operative association with each other in the above-described embodiment, but in place of the chain transmitting mechanism, any of a gear transmitting mechanism, a belt transmitting mechanism and any other transmitting mechanism can be employed. Any type of the oil pump 25 may be used, if it can be used as a lubricating pump for such type of the engine.

Further, the blow-by gas passages 92 and 102 have been made by drilling in the cylinder head 12 in addition to the annular blow-by gas passage 89 defined between the bolt insertion bore 81 and the through bolt 78 in the above-described embodiment, but an annular blow-by gas passage may be defined only between the bolt insertion bore 81 and the through bolt 78. Of the annular blow-by gas passage is defined only between the bolt insertion bore 81 and the through bolt 78, it is possible to provide a further reduction in size of the cylinder block 12. In addition, the present invention has been described by way of the example in which the oil escape groves 107', 87 and 107 have been provided in the bearing cap sections $17_1$, $17_3$ and $17_5$ and the connecting walls $66_1$, $66_3$ and $66_5$, but the oil escape grooves may be provided in at least one of the mating faces of both of the bearing cap sections and the connecting walls with the cylinder block.

Although the embodiment of the present invention has been described in detail, it will be understood that the present invention is not limited to the above-described embodiment, and various modifications in design may be made without departing from the spirit and scope of the invention defined in claims.

What is claimed is:

1. An engine for a vehicle, comprising a cylinder block, a cylinder head, a crankshaft and a bearing cap-integral type oil pan having a plurality of integral bearing cap sections coupled to said cylinder block, connecting members extending into said bearing cap sections from said cylinder block for integrally coupling said cylinder block and said oil pan to each other, wherein said oil pan has an oil pan chamber formed as an as-cast bore by drawing of a die in an axial direction of the crankshaft, said oil pan chamber extending in the axial direction of said crankshaft continuously over said bearing cap sections and between said bearing cap sections and a bottom wall of said oil pan, and having an opening at one end in the axial direction of said crankshaft.

2. An engine for a vehicle according to claim 1, wherein said bearing cap sections include bottomed threaded bores which open toward said cylinder block, and said connecting members are screwed into said threaded bores.

3. An engine for a vehicle according to claim 1, including baffle plates partitioning a crank chamber from said oil pan chamber, wherein adjacent said bearing cap sections are integrally connected to each other by said baffle plates.

4. An engine for a vehicle according to claim 1, including baffle plates partitioning a crank chamber from said oil pan chamber and reinforcing walls extending in the axial direction of said crankshaft, wherein adjacent said bearing cap sections are integrally connected to each other by said baffle plates and said reinforcing walls.

5. An engine for a vehicle according to claim 1, further including an oil pump mounted on the bottom wall of said oil pan.

6. An engine for a vehicle according to claim 5, wherein the position of fastening of the oil pump on the bottom wall of said oil pan is between adjacent said bearing cap sections.

7. An engine for a vehicle according to claim 1, wherein said oil pan includes left and right sidewalls, connected to opposite ends of each of said bearing cap sections, and wherein a thick mounting portion for mounting of an intake system member is integrally formed on an outer surface of one of said side walls.

8. An engine for a vehicle according to claim 7, wherein said mounting portion is integrally formed on the outer surface of said one sidewall at a location corresponding to said bearing cap section.

9. An engine for a vehicle according to claim 1, further including a timing transmitting mechanism positioned at one end of said cylinder block in the axial direction of said crankshaft for transmitting a driving force from said crankshaft to a valve operating cam shaft of the engine, and a transmitting case covering said timing transmitting mechanism, said transmitting case having an integral extension which extends to below a lower end of said cylinder block, wherein said oil pan has an oil pan body having an open end face at one end in the axial direction of said crankshaft defining said opening, and is coupled to a lower surface of said cylinder block, said oil pan comprising said oil pan body and said extension coupled to the open end face of said oil pan body.

10. An engine for a vehicle according to claim 9, wherein the inner surface of the bottom wall of said oil pan body is inclined with a downward gradient toward the open end face of said oil pan body, and said extension of said transmitting case has an oil discharge port at its lowermost end and a plug for closing said discharge port.

11. An engine for a vehicle according to claim 9, further including an auxiliary-driving wheel secured to the end of said crankshaft protruding outward from said transmitting case, and wherein said extension of said transmitting case protrudes to below said auxiliary-driving wheel.

12. An engine for a vehicle according to claim 9, further including a power transmitting means disposed within said transmitting case for transmitting rotational power from the crankshaft to an oil pump mounted on said oil pan body.

13. An engine for a vehicle according to claim 1, wherein said oil pan has an oil pan body integrally formed with said plurality of bearing cap sections and said oil pan body is coupled to a lower surface of said cylinder block; and said engine further includes an oil pump mounted on said oil pan body accommodated through said opening within said oil pan chamber, said oil pan chamber having a lid for closing said opening.

14. An engine for a vehicle according to claim 13, wherein said lid is an extension of a transmitting case secured to said cylinder block for covering a transmitting mechanism transmitting a rotational force of said crankshaft to a valve operating cam shaft.

15. An engine for a vehicle according to claim 13, wherein said oil pump is mounted on said oil pan body within said oil pan chamber at a position near said opening.

16. An engine for a vehicle according to claim 13, wherein said oil pan body has a mounting seat for said oil pump integrally formed at said opening, an oil supply passage between an oil supply system in said cylinder block and said oil pump, and a flange for fastening a transmission case at the other end thereof in the axial direction of said crankshaft.

17. An engine for a vehicle according to claim 1, wherein said cylinder block includes bolt insertion holes formed therein, and wherein said connecting members are through bolts passing through said bolt insertion holes for fastening said cylinder block, between said cylinder head and said bearing cap sections, and wherein annular oil return passages are formed between said through bolts and the inner surfaces of said bolt insertion bores.

18. An engine for a vehicle according to claim 17, including connecting walls, wherein said bearing cap sections are integrally connected to left and right sidewalls of said oil pan by said connecting walls, said connecting walls having oil escape passages extending in a direction parallel to said through bolts, and oil escape grooves connecting said oil return passages with said oil escape passages, formed in at least one of mating faces of said bearing cap section and said connecting walls with said cylinder block.

19. An engine for a vehicle according to claim 17, including connecting walls, wherein said bearing cap sections are integrally connected to left and right sidewalls of said oil pan by said connecting walls, wherein said engine includes a main gallery extending in the axial direction of said crankshaft between said oil pan and said cylinder block, and oil supply grooves for supplying an oil to crank journal portions of said crankshaft rotatably supported between said bearing cap sections and said cylinder block, said oil supply grooves being defined in at least one of mating faces of said bearing cap sections and said connecting walls with said cylinder block and lead to said main gallery.

20. An engine for a vehicle according to claim 1, wherein said cylinder block includes bolt insertion holes formed therein, and wherein said connecting bolts are through bolts passing through said bolt insertion holes for fastening said cylinder block, between said cylinder head and said bearing cap sections, and wherein annular blow-by gas passages are formed between said through bolts and the inner surfaces of said bolt insertion bores.

21. An engine for a vehicle, comprising a cylinder block, a cylinder head, a crankshaft and a bearing cap-integral type oil pan having a plurality of integral bearing cap sections coupled to said cylinder block, connecting members extending into said bearing cap sections from said cylinder block for integrally coupling said cylinder block and said oil pan to each other, wherein said oil pan has an oil pan chamber formed as an as-cast bore by drawing of a die in an axial direction of the crankshaft, said oil pan chamber extending in the axial direction of said crankshaft continuously over said bearing cap sections and between said bearing cap sections and a bottom wall of said oil pan, and having an opening at one end in the axial direction of said crankshaft, wherein said connecting members are through bolts, said through bolts being screwed into said bearing cap sections through said cylinder head above the cylinder block.

* * * * *